US009280071B2

(12) United States Patent
Maruyama et al.

(10) Patent No.: US 9,280,071 B2
(45) Date of Patent: Mar. 8, 2016

(54) METHOD OF PRODUCING ELECTROPHOTOGRAPHIC PHOTOSENSITIVE MEMBER, AND EMULSION FOR A CHARGE TRANSPORTING LAYER

(71) Applicant: CANON KABUSHIKI KAISHA, Tokyo (JP)

(72) Inventors: Akihiro Maruyama, Mishima (JP); Atsushi Okuda, Yokohama (JP); Takeshi Murakami, Numazu (JP); Hiroki Uematsu, Mishima (JP); Harunobu Ogaki, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 79 days.

(21) Appl. No.: 14/378,288

(22) PCT Filed: Mar. 15, 2013

(86) PCT No.: PCT/JP2013/058455

§ 371 (c)(1),
(2) Date: Aug. 12, 2014

(87) PCT Pub. No.: WO2013/141391

PCT Pub. Date: Sep. 26, 2013

(65) Prior Publication Data

US 2015/0037716 A1 Feb. 5, 2015

(30) Foreign Application Priority Data

Mar. 22, 2012 (JP) ..... 2012-065661
Feb. 27, 2013 (JP) ..... 2013-037192

(51) Int. Cl.

| | |
|---|---|
| ***G03G 5/00*** | (2006.01) |
| ***G03G 5/06*** | (2006.01) |
| ***G03G 5/05*** | (2006.01) |
| ***G03G 5/07*** | (2006.01) |

(52) U.S. Cl.
CPC ..... *G03G 5/0614* (2013.01); *G03G 5/051* (2013.01); *G03G 5/056* (2013.01); *G03G 5/0521* (2013.01);
(Continued)

(58) Field of Classification Search
CPC ..... G03G 5/0614
USPC ..... 430/73, 58.35
See application file for complete search history.

(56) References Cited

FOREIGN PATENT DOCUMENTS

JP 2007-79555 A 3/2007
JP 2009-288628 A 12/2009

(Continued)

OTHER PUBLICATIONS

U.S. Appl. No. 14/374,044, filed Jul. 23, 2014. Applicant: Takeshi Murakami.

(Continued)

*Primary Examiner* — Mark A Chapman
(74) *Attorney, Agent, or Firm* — Fitzpatrick, Cella, Harper and Scinto

(57) ABSTRACT

The present invention provides a method of producing an electrophotographic photosensitive member in which the amount of an organic solvent to be used for a coating solution for a charge transporting layer is reduced, and the stability of the coating solution for a charge transporting layer after preservation for a long time is improved, enabling formation of a charge transporting layer having high uniformity. The method includes: preparing a solution containing a charge transporting substance, a resin having a carbonyl group, and at least one compound selected from the group consisting of a compound represented by the formula (A), a compound represented by the formula (B), a compound represented by the formula (C), a compound represented by the formula (D), and a compound represented by the formula (E); dispersing the solution in water to prepare an emulsion; forming a coat by using the emulsion; and heating the coat to form a charge transporting layer.

11 Claims, 2 Drawing Sheets

(52) U.S. Cl.
CPC ..... *G03G 5/0525* (2013.01); *G03G 5/0564* (2013.01); *G03G 5/0571* (2013.01); *G03G 5/0637* (2013.01); *G03G 5/0638* (2013.01); *G03G 5/071* (2013.01)

(56) References Cited

FOREIGN PATENT DOCUMENTS

| | | | |
|---|---|---|---|
| JP | 2011-95664 | A | 5/2011 |
| JP | 2011-128213 | A | 6/2011 |
| WO | 2012/070472 | A1 | 5/2012 |

OTHER PUBLICATIONS

European Search Report dated Nov. 26, 2015 in European Application No. 13763644.5.

PCT International Search Report and Written Opinion of the International Searching Authority, International Application No. PCT/JP2013/058455, Mailing Date Jun. 25, 2013.

METHOD OF PRODUCING ELECTROPHOTOGRAPHIC PHOTOSENSITIVE MEMBER, AND EMULSION FOR A CHARGE TRANSPORTING LAYER

TECHNICAL FIELD

The present invention relates to a method of producing an electrophotographic photosensitive member, and an emulsion for a charge transporting layer.

BACKGROUND ART

Electrophotographic photosensitive members to be mounted on electrophotographic apparatuses include organic electrophotographic photosensitive members containing an organic photoconductive substance (hereinafter, also referred to as an "electrophotographic photosensitive member"). The organic electrophotographic photosensitive members are currently a mainstream as an electrophotographic photosensitive member used in a process cartridge for the electrophotographic apparatus or the electrophotographic apparatus, and produced in a large scale. Among these electrophotographic photosensitive members, a laminate type electrophotographic photosensitive member is often used, of which properties are improved by separately providing the functions necessary for the electrophotographic photosensitive member in individual layers.

A method of producing the laminate type electrophotographic photosensitive member is usually used in which a functional material is dissolved in an organic solvent to prepare an application solution (coating solution), and the coating solution is applied onto a support. Among the layers in the laminate type electrophotographic photosensitive member, a charge transporting layer often demands durability. For this reason, the charge transporting layer has a film thickness of a coat relatively thicker than those of other layers. Accordingly, a large amount of the coating solution is used for the charge transporting layer, resulting in a large amount of the organic solvent to be used. In order to reduce the amount of the organic solvent to be used in production of the electrophotographic photosensitive member, the amount of the organic solvent to be used for the coating solution for a charge transporting layer is desirably reduced. To prepare the coating solution for a charge transporting layer, however, a halogen solvent or an aromatic organic solvent needs to be used because a charge transporting substance and a resin are highly soluble in the halogen solvent or the aromatic organic solvent. For this reason, the amount of the organic solvent to be used is difficult to reduce.

PTL 1 discloses an attempt to reduce a volatile substance and the amount of an organic solvent to be used in a coating solution for forming a charge transporting layer (coating solution for a charge transporting layer). PTL 1 discloses preparation of an emulsion type coating solution (emulsion) by forming an organic solution into oil droplets in water in which the organic solution is prepared by dissolving a substance included in a charge transporting layer in an organic solvent.

CITATION LIST

Patent Literature

PTL 1: Japanese Patent Application Laid-Open No. 2011-128213

SUMMARY OF INVENTION

Technical Problem

As a result of research by the present inventors, however, it was found out that in the method of producing an electrophotographic photosensitive member disclosed in PTL 1 in which the emulsion is prepared, the emulsion is uniformly emulsified immediately after the preparation of the emulsion, but the liquid properties of the emulsion may be reduced after the emulsion is left as it is for a long time.

The reason for this is thought as follows: the organic solution prepared by dissolving the substance included in a charge transporting layer in the organic solvent coalesces in water as the time has passes; this coalescence makes it difficult to form a stable state of oil droplets, leading to aggregation or sediment. Then, further improvement is desired from the viewpoint of reducing the amount of the organic solvent to be used and ensuring the stability of the coating solution for a charge transporting layer at the same time.

An object of the present invention is to provide a method of producing an electrophotographic photosensitive member in which the amount of an organic solvent to be used for a coating solution for a charge transporting layer is reduced, and the stability of the coating solution for a charge transporting layer after preservation for a long time is improved, enabling formation of a charge transporting layer having high uniformity. Another object of the present invention is to provide a coating solution for a charge transporting layer having high stability after preservation for a long time.

Solution to Problem

The objects above are attained by the present invention below. The present invention is a method of producing an electrophotographic photosensitive member which includes a support and a charge transporting layer formed thereon, the method including:

preparing a solution including: a charge transporting substance; a resin having a carbonyl group; and at least one compound selected from the group consisting of a compound represented by the following formula (A), a compound represented by the following formula (B), a compound represented by the following formula (C), a compound represented by the following formula (D), and a compound represented by the following formula (E); and dispersing the solution in water to prepare an emulsion;

forming a coat by using the emulsion; and heating the coat to form the charge transporting layer,

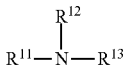

(A)

where $R^{11}$ to $R^{13}$ each independently represent a hydrogen atom, an alkyl group having 1 to 6 carbon atoms, a hydroxyalkyl group having 1 to 3 carbon atoms or a hydroxy group, (B)

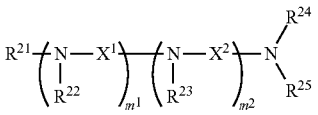

where $R^{21}$ to $R^{25}$ each independently represent a hydrogen atom, an alkyl group having 1 to 6 carbon atoms, a hydroxyalkyl group having 1 to 3 carbon atoms or a hydroxy group; $m^1$ is 1 or 2; $m^2$ is an integer selected from 0 to 2; $X^1$ represents a divalent group represented by the following formula (BA); $X^2$ represents a divalent group represented by the following formula (BB), (BA)

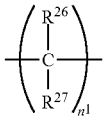

(BB)

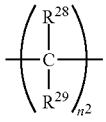

wherein in the formula (BA), $R^{26}$ and $R^{27}$ each independently represent a hydrogen atom, a methyl group or an ethyl group; $n^1$ represents an integer selected from 1 to 6; in the formula (BB), $R^{28}$ and $R^{29}$ each independently represent a hydrogen atom, a methyl group or an ethyl group; $n^2$ represents an integer selected from 1 to 6, (C)

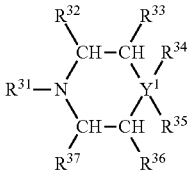

where $R^{32}$, $R^{33}$, $R^{36}$ and $R^{37}$ each independently represent a hydrogen atom, a methyl group, a hydroxy group or an amino group; $R^{31}$ represents a hydrogen atom, an amino group, a hydroxy group or a hydroxyalkyl group having 1 to 3 carbon atoms; $Y^1$ represents a nitrogen atom, an oxygen atom or a carbon atom; $R^{34}$ and $R^{35}$ are absent when $Y^1$ is the oxygen atom; $R^{34}$ represents a hydrogen atom, a hydroxy group or an amino group, and $R^{35}$ is absent when $Y^1$ is the nitrogen atom; $R^{34}$ and $R^{35}$ each independently represent a hydrogen atom, a hydroxy group or an amino group when $Y^1$ is the carbon atom; $R^{31}$ and $R^{34}$ may be bonded to each other so as to be cyclic, (D)

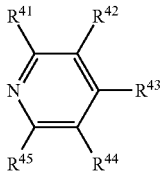

where $R^{41}$ to $R^{45}$ each independently represent a hydrogen atom, a methyl group, a methoxy group, an amino group, a dimethylamino group or a hydroxyl group, (E)

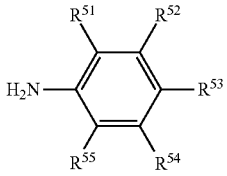

where $R^{51}$ to $R^{55}$ each independently represent a hydrogen atom, a methyl group or an ethyl group.

The present invention is a method of producing an electrophotographic photosensitive member which includes a support and a charge transporting layer formed thereon, the method including:

preparing a solution including a charge transporting substance and a resin having a carbonyl group;

dispersing the solution and at least one compound selected from the group consisting of the compound represented by the formula (A), the compound represented by the formula (B), the compound represented by the formula (C), the compound represented by the formula (D), and the compound represented by the formula (E) in water to prepare a emulsion;

forming a coat by using the emulsion; and heating the coat to form the charge transporting layer.

The present invention also relates to an emulsion for a charge transporting layer in which a solution is dispersed in water, wherein the solution contains a charge transporting substance and a resin having a carbonyl group, and the emulsion for a charge transporting layer further contains at least one compound selected from the group consisting of the compound represented by the formula (A), the compound represented by the formula (B), the compound represented by the formula (C), the compound represented by the formula (D), and the compound represented by the formula (E).

Advantageous Effects of Invention

The present invention can provide a method of producing an electrophotographic photosensitive member in which the stability of the coating solution for a charge transporting layer (emulsion) after preservation for a long time can be improved, enabling formation of a charge transporting layer having high uniformity. Moreover, the present invention can provide a coating solution for a charge transporting layer (emulsion) having high stability after preservation for a long time.

Further features of the present invention will become apparent from the following description of exemplary embodiments with reference to the attached drawings.

DESCRIPTION OF EMBODIMENTS

Figure 1A:
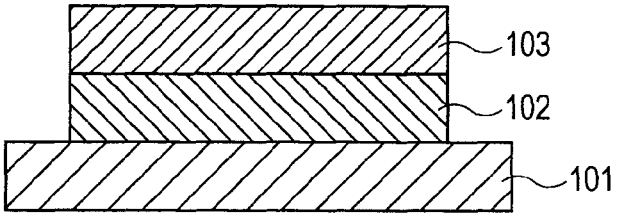
FIGS. 1A and 1B are drawings showing an example of a layer configuration in an electrophotographic photosensitive member according to the present invention.

Preferred embodiments of the present invention will now be described in detail in accordance with the accompanying drawings.

The present inventors think the reason why the method of producing an electrophotographic photosensitive member according to the present invention can improve the stability of the emulsion (coating solution for a charge transporting layer) after preservation for a long time, enabling formation of a charge transporting layer having high uniformity as follows.

In the present invention, the solution containing the charge transporting substance, the resin having a carbonyl group, and at least one compound selected from the group consisting of the compound represented by the formula (A), the compound represented by the formula (B), the compound represented by the formula (C), the compound represented by the formula (D), and the compound represented by the formula (E) (amine compound) is prepared. It is thought that by dispersing the solution in water to prepare an emulsion, the emulsion never aggregates (coalesces) even if the emulsion is preserved for a long time, attaining the effect of the present invention.

In a method in which a solution containing the charge transporting substance and the resin having a carbonyl group is prepared without the amine compound above, and the solution is dispersed in water to prepare an emulsion, however, oil droplets in the emulsion easily aggregate (coalesce) after the emulsion is preserved for a long time. Moreover, as the technique in PTL 1, a period for which the oil droplet state of the emulsion is kept can be extended by containing a large amount of a surfactant, but the oil droplet state (emulsion) is difficult to keep stably over a long period of time, and aggregation (coalescence) easily occurs.

In the present invention, the emulsion never aggregates (coalesces) and the stability of the emulsion after preservation for a long time is enhanced in all the cases where the amine compound is added to the solution, the amine compound is added to water, and the amine compound is added to the solution and water in the preparation of the emulsion. The reason is thought as follows: the solution containing the charge transporting substance and the resin having a carbonyl group acts with the amine compound having affinity with water to reduce the size of the oil droplets, enabling significant suppression of the aggregation of the oil droplets to occur. A nitrogen atom having an unshared electron pair (hereinafter, referred to as a basic nitrogen atom) in the amine compound interacts with a carbonyl group in the resin having a carbonyl group to promote polarization of an oxygen atom in the carbonyl group. It is thought that this polarization causes the carbonyl group to exist in the vicinity of the surfaces of the oil droplets, leading to stabilization of the oil droplet particles in water and suppression of production of aggregation of the oil droplets. Additionally, the amine compound has bulkiness around the basic nitrogen atom that allows interaction with the carbonyl group in the resin having a carbonyl group, and amphiphilicity allowing dissolution in both water and oil. For this reason, it is thought that the amine compound can freely move between water and the oil droplets, acts to polarize the carbonyl group in the resin having a carbonyl group in the oil droplets, and suppresses aggregation of the oil droplets. For this reason, the emulsified state can be kept even after the emulsion is preserved for a long time, and the stability of the emulsion is enhanced. Aggregation of the emulsion caused by preservation for a long time is also suppressed. For this reason, a charge transporting layer having high uniformity can be formed after preservation for a long time.

Even after preservation for a long time, the emulsion having uniform oil droplets can be applied to a support to form a uniform coat. It is thought that this is because a coat of the emulsion is uniformly formed on the support. In the case where the emulsion having remarkable coalescence of the oil droplets is applied, however, no uniform coat of the emulsion is formed on the support, the film thickness becomes uneven, and no uniform coat can be obtained.

Hereinafter, materials that form the electrophotographic photosensitive member produced in the present invention will be described.

The electrophotographic photosensitive member includes a support and a charge transporting layer formed thereon. The electrophotographic photosensitive member can be a laminate type (function separate type) photosensitive layer in which a charge generating layer containing a charge generating substance and a charge transporting layer containing a charge transporting substance are separately provided. The laminate type photosensitive layer may be a normal layer type photosensitive layer in which the charge generating layer and the charge transporting layer are laminated in this order from the side of the support, or may be an inverted layer type photosensitive layer in which the charge transporting layer and the charge generating layer are laminated in this order from the side of the support. From the viewpoint of electrophotographic properties, the normal layer type photosensitive layer can be used.

Figure 1B:
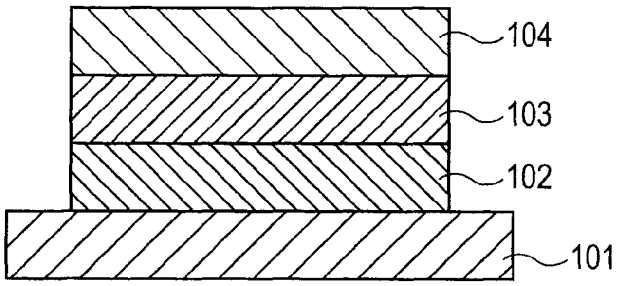

FIGS. 1A and 1B are drawings showing an example of a layer configuration of the electrophotographic photosensitive member according to the present invention. In FIGS. 1A and 1B, a support 101, a charge generating layer 102, a charge transporting layer 103, and a protective layer 104 (second charge transporting layer) are shown. When necessary, an undercoat layer may be provided between the support 101 and the charge generating layer 102.

Next, the compound represented by the formula (A), the compound represented by the formula (B), the compound represented by the formula (C), the compound represented by the formula (D), and the compound represented by the formula (E) in the present invention will be described.

(A)

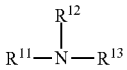

wherein $R^{11}$ to $R^{13}$ each independently represent a hydrogen atom, an alkyl group having 1 to 6 carbon atoms, a hydroxyalkyl group having 1 to 3 carbon atoms or a hydroxy group.

(B)

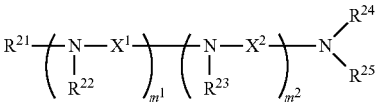

wherein $R^{21}$ to $R^{25}$ each independently represent a hydrogen atom, an alkyl group having 1 to 6 carbon atoms, a hydroxyalkyl group having 1 to 3 carbon atoms or a hydroxy group; $m^1$ is 1 or 2; $m^2$ is an integer selected from 0 to 2; $X^1$ represents a divalent group represented by the following formula (BA), and $X^2$ represents a divalent group represented by the following formula (BB):

(BA)

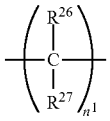

(BB)

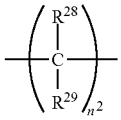

wherein in the formula (BA), $R^{26}$ and $R^{27}$ each independently represent a hydrogen atom, a methyl group or an ethyl group; $n^1$ represents an integer selected from 1 to 6; in the formula (BB), $R^{28}$ and $R^{29}$ each independently represent a hydrogen atom, a methyl group or an ethyl group; $n^2$ represents an integer selected from 1 to 6.

(C)

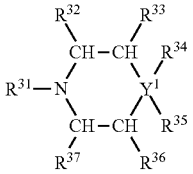

wherein $R^{32}$, $R^{33}$, $R^{36}$ and $R^{37}$ each independently represent a hydrogen atom, a methyl group, a hydroxyl group or an amino group; $R^{31}$ represents a hydrogen atom, an amino group, a hydroxy group or a hydroxyalkyl group having 1 to 3 carbon atoms; $Y^1$ represents a nitrogen atom, an oxygen atom or a carbon atom; $R^{34}$ and $R^{35}$ are absent when $Y^1$ is the oxygen atom; $R^{34}$ represents a hydrogen atom, a hydroxy group or an amino group, and $R^{35}$ is absent when $Y^1$ is the nitrogen atom; $R^{34}$ and $R^{35}$ each independently represent a hydrogen atom, a hydroxy group or an amino group when $Y^1$ is the carbon atom; and $R^{31}$ and $R^{34}$ may be bonded to each other so as to be cyclic.

(D)

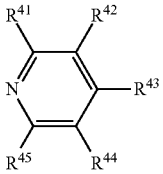

wherein $R^{41}$ to $R^{45}$ each independently represent a hydrogen atom, a methyl group, a methoxy group, an amino group, a dimethylamino group or a hydroxy group.

(E)

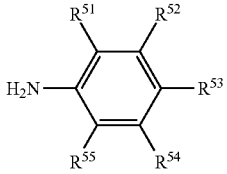

wherein $R^{51}$ to $R^{55}$ each independently represent a hydrogen atom, a methyl group or an ethyl group.

In the formulas (A) to (E), examples of the alkyl group having 1 to 6 carbon atoms include a methyl group, an ethyl group, an n-propyl group, an n-butyl group, an n-pentyl group, an n-hexyl group, an isopropyl group, a sec-butyl group, an isobutyl group and a tert-butyl group. Examples of the hydroxyalkyl group having 1 to 3 carbon atoms include a hydroxymethyl group, a hydroxyethyl group and a hydroxypropyl group.

Hereinafter, specific examples of the compound represented by the formula (A) are shown:

(A-1)

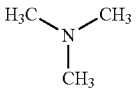

(A-2)

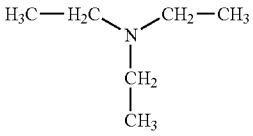

(A-3)

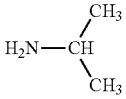

(A-4)

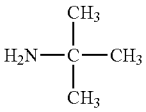

(A-5)

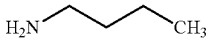

(A-6)

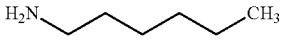

(A-7)

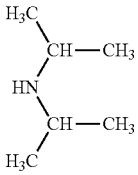

(A-8)

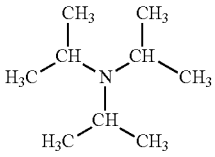

(A-9)

(A-10)

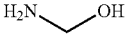

-continued
(A-11)
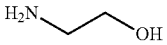
(A-12)
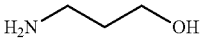
(A-13)
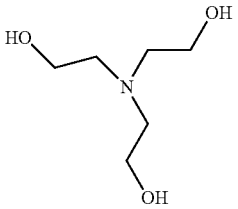
(A-14)
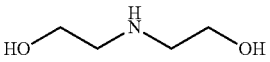
Hereinafter, specific examples of the compound represented by the formula (B) are shown:
(B-1)
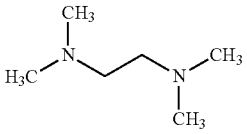
(B-2)
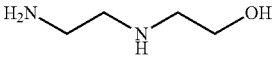
(B-3)
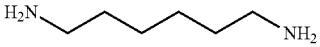
(B-4)
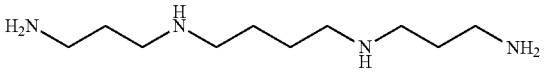
Hereinafter, specific examples of the compound represented by the formula (C) are shown:
(C-1)
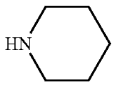
(C-2)
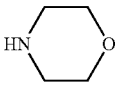
(C-3)
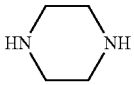
(C-4)
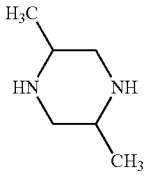
-continued
(C-5)
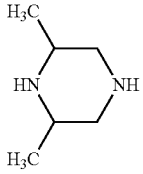
(C-6)
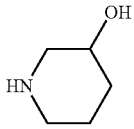
(C-7)
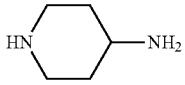
(C-8)
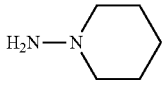
(C-9)
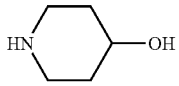
(C-10)
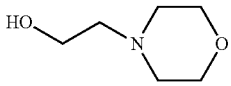
(C-11)
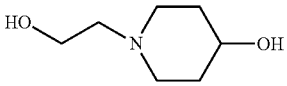
(C-12)
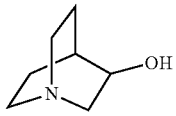
Hereinafter, specific examples of the compound represented by the formula (D) are shown:
(D-1)
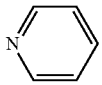
(D-2)
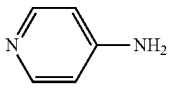
(D-3)
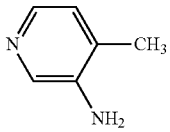
(D-4)
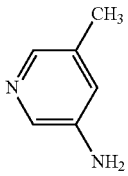

-continued (D-5)

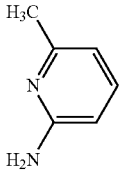

(D-6)

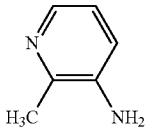

(D-7)

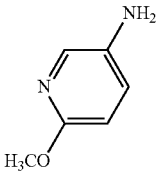

(D-8)

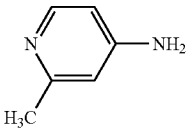

(D-9)

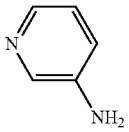

(D-10)

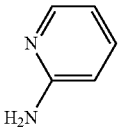

(D-11)

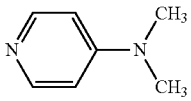

-continued (D-12)

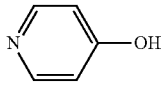

Hereinafter, specific examples of the compound represented by the formula (E) are shown:

(E-1)

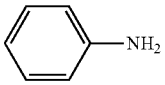

(E-2)

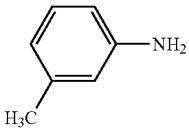

(E-3)

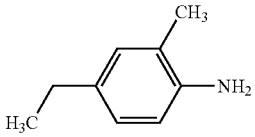

The content of the amine compound is preferably not less than 0.1% by mass and not more than 30% by mass, and more preferably not less than 0.1% by mass and not more than 20% by mass based on the total mass of the emulsion. The amine compound may be contained in water in advance, or may be contained in the solution containing the charge transporting substance and the resin having a carbonyl group. Alternatively, the amine compound may be contained in both of these (in water and the solution), and be emulsified.

The charge transporting substance is a substance having a hole transporting ability. Examples of the charge transporting substance include triarylamine compounds or hydrazone compounds. Among these, use of the triarylamine compounds can be used from the viewpoint of improving the electrophotographic properties.

The specific examples of the charge transporting substance are shown below:

(1-1)

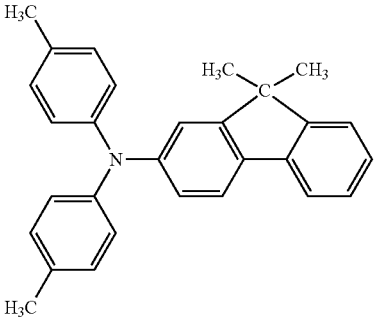

(1-2)

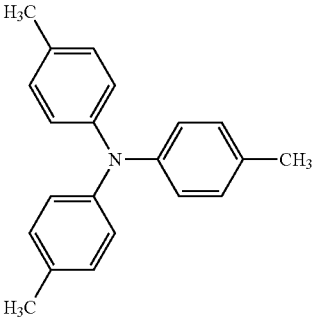

-continued
(1-3)
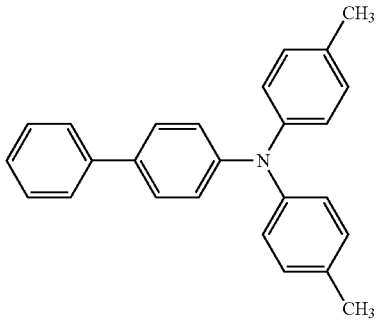
(1-4)
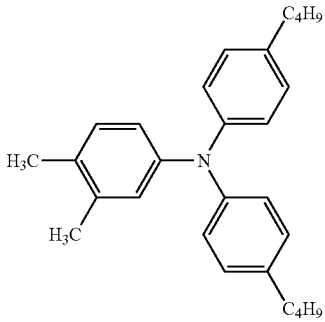
(1-5)
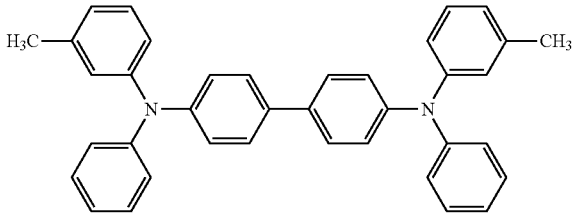
(1-6)
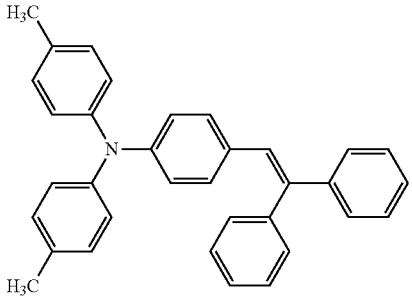
(1-7)
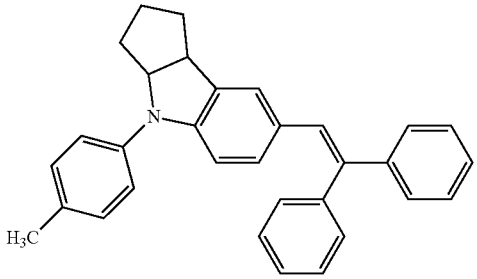
(1-8)
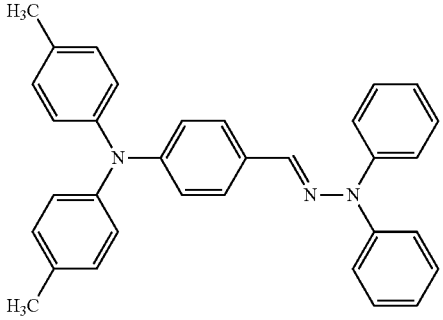
(1-9)
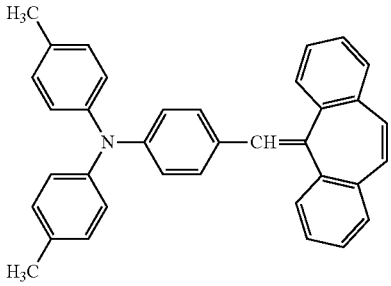
(1-10)
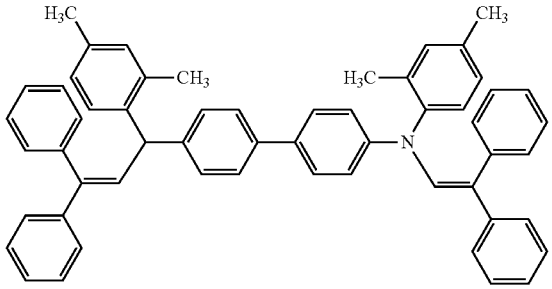
(1-11)
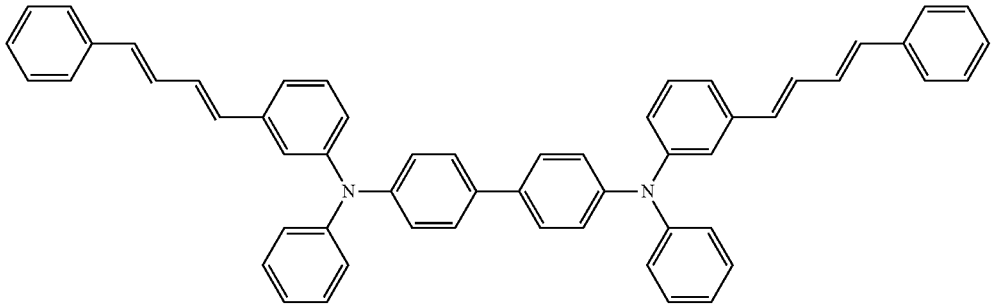

The charge transporting substance may be used alone or in combination.

Examples of the resin having a carbonyl group used for the charge transporting layer include polyamide resins, polyvinyl acetate resins, polyurethane resins, urea resins, polycarbonate resins and polyester resins.

Among these, polycarbonate resins or polyester resins can be used. Further, polycarbonate resins having a repeating structural unit represented by the following formula (2) or polyester resins having a repeating structural unit represented by the following formula (3) can be used. In the present invention, the resin having a carbonyl group serves as a binder resin.

(2)

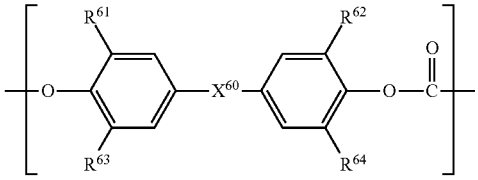

where $R^{61}$ to $R^{64}$ each independently represent a hydrogen atom or a methyl group; $X^{60}$ represents a single bond, a methylene group, an ethylidene group, a propylidene group, a phenylethylidene group, a cyclohexylidene group or an oxygen atom.

(3)

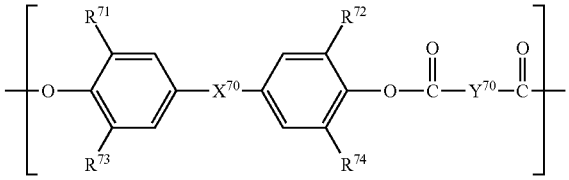

where $R^{71}$ to $R^{74}$ each independently represent a hydrogen atom or a methyl group; $X^{70}$ represents a single bond, a methylene group, an ethylidene group, a propylidene group, a cyclohexylidene group or an oxygen atom; $Y^{70}$ represents an m-phenylene group, a p-phenylene group or a divalent group having two p-phenylene groups bonded with an oxygen atom.

Specific examples of the repeating structural unit represented by the formula (2) are shown below:

(2-1)

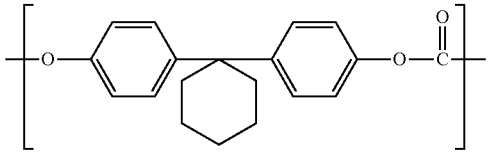

(2-2)

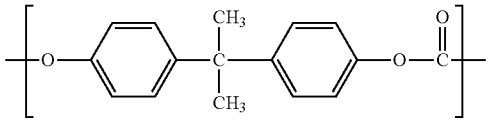

(2-3)

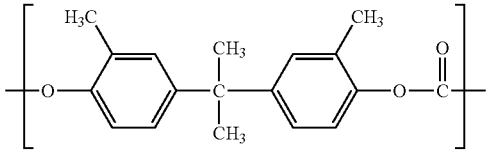

(2-4)

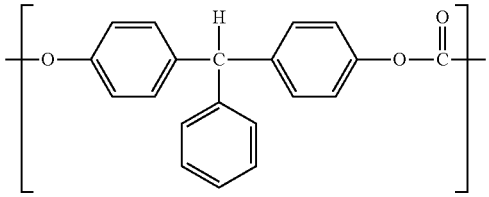

(2-5)

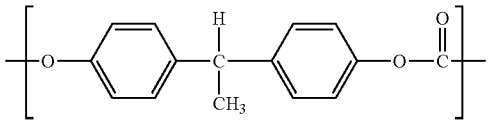

(2-6)

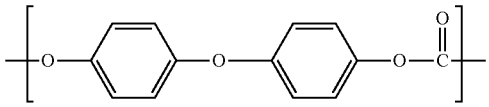

(2-7)

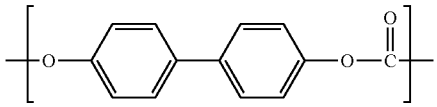

(2-8)

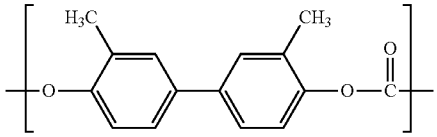

Specific examples of the repeating structural unit represented by the formula (3) are shown below:

(3-1)

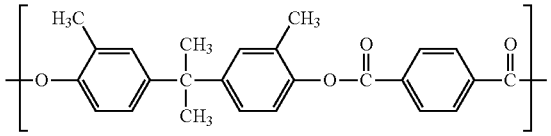

(3-2)

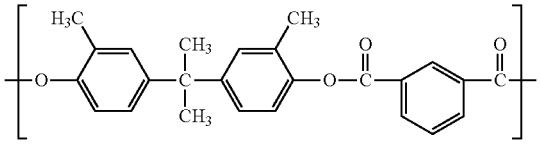

-continued (3-3)

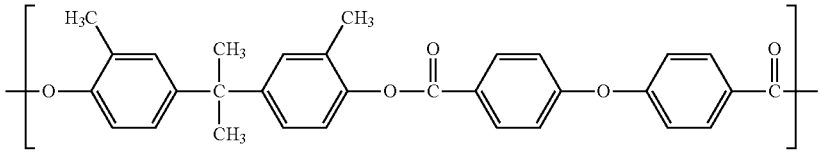

(3-4)

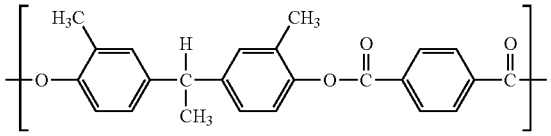

(3-5)

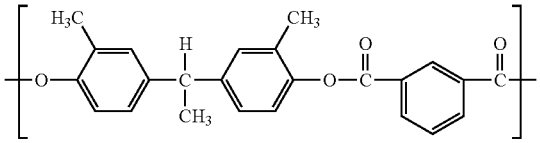

(3-6)

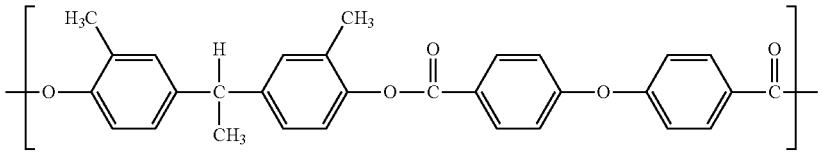

These polycarbonate resins and polyester resins can be used alone, or can be used in combination by mixing or as a copolymer. The form of the copolymerization may be any form of block copolymerization, random copolymerization and alternating copolymerization.

The weight average molecular weight of the resin having a carbonyl group is a weight average molecular weight in terms of polystyrene measured according to the standard method, specifically according to the method described in Japanese Patent Application Laid-Open No. 2007-79555.

The charge transporting layer may contain additives other than the charge transporting substance and the resin having a carbonyl group. Examples of the additives contained in the charge transporting layer include deterioration preventing agents such as an antioxidant, an ultraviolet absorbing agent and a light stabilizer, and resins giving releasing properties. Examples of the deterioration preventing agents include hindered phenol antioxidants, hindered amine light stabilizers, sulfur atom-containing antioxidants and phosphorus atom-containing antioxidants. Examples of the resins giving releasing properties include fluorine atom-containing resins and resins having a siloxane structure.

Hereinafter, as an organic solvent used in preparation of the solution in the present invention, a liquid (hydrophobic solvent) whose solubility in water is 1.0% by mass or less at 25° C. and 1 atm (atmospheric pressure) can be used. Representative examples of the hydrophobic solvent are shown in Table 1 below.

TABLE 1

Representative examples of hydrophobic solvent

| No | Name |
|---|---|
| (E-1) | Toluene |
| (E-2) | Chloroform |
| (E-3) | o-Dichlorobenzene |
| (E-4) | Chlorobenzene |
| (E-5) | o-Xylene |
| (E-6) | Ethylbenzene |
| (E-7) | Phenetole |

Further, solvents having an aromatic ring structure are more preferable. Among these, at least one of toluene and xylene is more preferable from the viewpoint of stabilization of the emulsion. These solvents may be mixed in combination and used.

Further, in addition to the solvents above, at least one of the solvents shown in Table 2 may be mixed and used.

TABLE 2

Representative examples of solvent

| No | Name |
|---|---|
| (F-1) | Tetrahydrofuran |
| (F-2) | Dimethoxymethane |
| (F-3) | 1,2-Dioxane |
| (F-4) | 1,3-Dioxane |
| (F-5) | 1,4-Dioxane |
| (F-6) | 1,3,5-Trioxane |
| (F-7) | Methanol |
| (F-8) | 2-Pentanone |
| (F-9) | Ethanol |
| (F-10) | Tetrahydropyran |
| (F-11) | Diethylene glycol dimethyl ether |
| (F-12) | Ethylene glycol dimethyl ether |
| (F-13) | Propylene glycol n-butyl ether |
| (F-14) | Propylene glycol monopropyl ether |
| (F-15) | Ethylene glycol monomethyl ether |
| (F-16) | Diethylene glycol monoethyl ether |
| (F-17) | Ethylene glycol monoisopropyl ether |
| (F-18) | Ethylene glycol monobutyl ether |
| (F-19) | Ethylene glycol monoisobutyl ether |
| (F-20) | Ethylene glycol monoallyl ether |
| (F-21) | Propylene glycol monomethyl ether |
| (F-22) | Dipropylene glycol monomethyl ether |
| (F-23) | Tripropylene glycol monomethyl ether |
| (F-24) | Propylene glycol monobutyl ether |
| (F-25) | Propylene glycol monomethyl ether acetate |
| (F-26) | Diethylene glycol methyl ethyl ether |
| (F-27) | Diethylene glycol diethyl ether |
| (F-28) | Dipropylene glycol dimethyl ether |
| (F-29) | Propylene glycol diacetate |
| (F-30) | Methyl acetate |
| (F-31) | Ethyl acetate |
| (F-32) | n-Propyl alcohol |
| (F-33) | 3-Methoxy butanol |
| (F-34) | 3-Methoxybutyl acetate |
| (F-35) | Ethylene glycol monomethyl ether acetate |

Among these, ether solvents are preferable, and further, at least one of tetrahydrofuran and dimethoxymethane is more preferable from the viewpoint of stabilization of the emulsion.

Next, a method in which the solution prepared by the method described above is dispersed in water to prepare an emulsion will be described.

An emulsifying method for preparing an emulsion will be described. The emulsifying method will be described below, but the production method according to the present invention will not be limited to this. The charge transporting substance, the resin having a carbonyl group, and at least one of the compounds represented by the formulas (A) to (E) are dissolved in the organic solvent described above (solvents shown in Tables 1 and 2) to prepare a solution. Then, the solution is mixed with water and stirred, and dispersed in water to prepare an emulsion. At this time, the solution having the charge transporting substance, the resin having a carbonyl group, and at least one of the compounds represented by the formulas (A) to (E) dissolved in the organic solvent described above may be dropped and added into water which is being stirred, or may be added at one time to water and stirred.

Alternatively, the charge transporting substance and the resin having a carbonyl group are dissolved in the organic solvent described above to prepare a solution, and at least one of the compounds represented by the formulas (A) to (E) (amine compound) and water are mixed with the solution and stirred. The solution is dispersed to prepare an emulsion. At this time, the solution having the charge transporting substance and the resin having a carbonyl group dissolved in the organic solvent described above may be dropped and added to water containing at least one of the compounds represented by the formulas (A) to (E) and being stirred. Alternatively, the solution having the charge transporting substance and the resin having a carbonyl group dissolved in the organic solvent described above and the amine compound may be added to water at one time, and stirred.

As an emulsifying method for preparing an emulsion, an existing emulsifying method can be used. The emulsion according to the present invention contains at least the charge transporting substance and the resin having a carbonyl group in the state where at least part of the charge transporting substance and the resin having a carbonyl group are dissolved in the emulsion particles. As a specific emulsifying method, a stirring method and a high pressure collision method will be shown below, but the production method according to the present invention will not be limited to these.

The stirring method will be described. In the method, the charge transporting substance and the resin having a carbonyl group are dissolved in the organic solvent described above to prepare a solution. The solution is mixed with water, and stirred by a stirrer to disperse the solution in water. Here, from the viewpoint of the electrophotographic properties, water used in the present invention can be ion exchange water from which metal ions and the like are removed with an ion exchange resin or the like. The ion exchange water can have a conductivity of 5 μS/cm or less. As the stirrer, a stirrer enabling high speed stirring can be used because a uniform emulsion can be prepared in a short time. Examples of the stirrer include a homogenizer (Physcotron) made by MICROTEC CO., LTD. and a circulation homogenizer (Cleamix) made by M Technique Co., Ltd.

The high pressure collision method will be described. In the method, the charge transporting substance and the resin having a carbonyl group are dissolved in the organic solvent described above to prepare a solution. The solution is mixed with water, and the mixed solution is collided under high pressure to disperse the solution in water. Thus, an emulsion can be prepared. Alternatively, without mixing the solution with water, the solution may be collided with water as individual solutions to prepare an emulsion. Examples of a high pressure colliding apparatus include a Microfluidizer M-110EH made by Microfluidics Corporation in U.S. and a Nanomizer YSNM-2000AR made by YOSHIDA KIKAI CO., LTD.

The content of water in the emulsion is preferably not less than 30% by mass and less than 100% by mass based on the emulsion. More preferably, the ratio ((a+ct+r)/w) of the total mass (a+ct+r) of the mass (ct) of the charge transporting substance, and the mass (r) of the resin having a carbonyl group, and the mass (a) of the organic solvent to the mass (w) of water is 7/3 to 2/8, and more preferably 5/5 to 3/7 from the viewpoint of stabilization of the emulsion. In the ratio of the solution to water, a higher proportion of water is preferable from the viewpoint of reducing the size of the oil droplets when the solution is emulsified, and stabilizing the emulsion. The ratio can be adjusted in the range in which the charge transporting substance and the resin having a carbonyl group are dissolved in the organic solvent, such that the size of the oil droplets are reduced and the solution stability is further enhanced.

The proportion of the charge transporting substance and the resin having a carbonyl group to the organic solvent in the oil droplets of the emulsion is preferably 10 to 50% by mass based on the organic solvent. The proportion of the charge transporting substance to the resin having a carbonyl group is preferably in the range of 4:10 to 20:10 (mass ratio), and more preferably in the range of 5:10 to 12:10 (mass ratio). The ratio of the charge transporting substance to the resin having a carbonyl group is adjusted so as to have such ratio. In the case where the additives described above are further added to the solution, the content of the additives is preferably 50% by mass or less, and more preferably 30% by mass or less based on the total mass of the charge transporting substance and the resin having a carbonyl group.

Moreover, the emulsion may contain a surfactant for the purpose of further stabilizing the emulsion. As the surfactant, a nonionic surfactant (nonionic surfactant) can be used from the viewpoint of suppressing reduction in the electrophotographic properties. The nonionic surfactant has a hydrophilic portion which is a non-electrolyte, that is, not ionized. Examples of the nonionic surfactant include:

NAROACTY Series, EMULMIN Series, SANNONIC Series, and NEWPOL Series made by Sanyo Chemical Industries, Ltd., EMULGEN Series, RHEODOL Series, and EMANON Series made by Kao Corporation, Adekatol Series, ADEKA ESTOL Series, and ADEKA NOL Series made by ADEKA Corporation, and nonionic surfactant Series among Newcol Series made by NIPPON NYUKAZAI CO., LTD.

These surfactants can be used alone or in combination. The surfactant having an HLB value (Hydrophile-Lipophile Balance value) in the range of 8 to 15 can be selected for stabilization of the emulsion.

The amount of the surfactant to be added is preferably as small as possible from the viewpoint of preventing reduction in the electrophotographic properties. The content of the surfactant in the emulsion is preferably in the range of 0% by mass to 1.5% by mass, and more preferably in the range of 0% by mass to 0.5% by mass based on the total mass of the charge transporting substance and the binder resin. The surfactant may be contained in water in advance, or may be contained in the solution containing the charge transporting substance and the resin having a carbonyl group. Alternatively, the surfactant may be contained in both water and the solution.

Moreover, the emulsion may contain additives such as an antifoaming agent and a viscoelastic adjuster in the range in which the effect of the present invention is not inhibited.

The average particle diameter of the emulsion particle in the emulsion is preferably in the range of 0.1 to 20.0 μm, and more preferably in the range of 0.1 to 5.0 μm from the viewpoint of further stability of the emulsion.

Next, a method of applying the coat of the emulsion onto a support will be described.

As a step of forming the coat of the emulsion, any of existing coating methods such as a dip coating method, a ring coating method, a spray coating method, a spinner coating method, a roller coating method, a Meyer bar coating method, and a blade coating method can be used. From the viewpoint of productivity, the dip coating can be used. According to the dip coating method, the emulsion can be applied onto a support to form a coat.

Next, a step of heating the coat to form a charge transporting layer will be described. The formed coat is heated to form a charge transporting layer.

The coat of the emulsion may be formed on the charge generating layer. Alternatively, the coat of the emulsion may be formed on an undercoat layer, and the charge generating layer may be formed on the coat. Further, in the case where the charge transporting layer has a laminate structure (first charge transporting layer, second charge transporting layer), the coat of the emulsion may be formed on the first charge transporting layer to form the second charge transporting layer. Alternatively, using the coat of the emulsion according the present invention, both of the first charge transporting layer and the second charge transporting layer may be formed.

In the present invention, the emulsion containing at least the charge transporting substance and the resin having a carbonyl group is applied to form the coat. For this reason, by heating the coat, the dispersion medium (water) can be removed and the emulsion particles can be brought into close contact with each other at the same time. Thereby, a more uniform coat can be formed. Further, if the emulsion particle has a smaller particle diameter, a film thickness having high uniformity can be quickly obtained after the dispersion medium is removed. Accordingly, a smaller particle diameter of the emulsion particle is preferable. A heating temperature can be 100° C. or more. Further, from the viewpoint of enhancing close contact of the emulsion particles, the heating temperature can be a heating temperature of the melting point or more of the charge transporting substance having the lowest melting point among the charge transporting substances that form the charge transporting layer. By heating at a temperature of the melting point or more of the charge transporting substance, the charge transporting substance is fused. The resin having a carbonyl group is dissolved in the fused charge transporting substance. Thereby, a highly uniform coat can be formed. Further, heating can be performed at a heating temperature 5° C. or more higher than the melting point of the charge transporting substance having the lowest melting point among the charge transporting substances that form the charge transporting layer. Moreover, the heating temperature can be 200° C. or less. Occurrence of modification or the like of the charge transporting substance can be suppressed, obtaining sufficient electrophotographic properties.

The film thickness of the charge transporting layer produced by the production method according to the present invention is preferably not less than 3 μm and not more than 50 μm, and more preferably not less than 5 μm and not more than 35 μm.

Next, the configuration of the electrophotographic photosensitive member produced by the production method above will be described.

A cylindrical electrophotographic photosensitive member formed of a cylindrical support and a photosensitive layer (charge generating layer, charge transporting layer) formed thereon is usually widely used, but the electrophotographic photosensitive member can have a belt-like shape or a sheet-like shape, for example.

As the support, those having conductivity (electrically conductive support) can be used. A metallic conductive support made of aluminum, an aluminum alloy, stainless steel, or the like can be used. In the case of the aluminum or aluminum alloy conductive support, an ED tube, an EI tube, or those subjected to machining, electrochemical mechanical polishing, a wet or dry honing treatment can also be used. Moreover, a metallic conductive support or a resin conductive support having a layer of a coat formed by vacuum depositing aluminum, an aluminum alloy or an indium oxide-tin oxide alloy can also be used. Moreover, a conductive support formed by impregnating conductive particles such as carbon black, tin oxide particles, titanium oxide particles, and silver particles into a resin, or a plastic having a conductive resin can also be used.

The surface of the support may be subjected to a machining treatment, a surface roughening treatment, an anodic oxidation treatment, or the like.

An electrically conductive layer may be provided between the support and an undercoat layer or charge generating layer described later. The electrically conductive layer can be obtained by forming a coat on the support using a coating solution for an electrically conductive layer in which conductive particles are dispersed in a resin, and drying the coat. Examples of the conductive particles include carbon black, acetylene black, metal powders of aluminum, nickel, iron, nichrome, copper, zinc, and silver, and metal oxide powders of conductive tin oxide and ITO.

Examples of the resin include polyester resins, polycarbonate resins, polyvinyl butyral resins, acrylic resins, silicone resins, epoxy resins, melamine resins, urethane resins, phenol resins and alkyd resins.

Examples of a solvent used in the coating solution for an electrically conductive layer include ether solvents, alcohol solvents, ketone solvents and aromatic hydrocarbon solvents.

The film thickness of the electrically conductive layer is preferably not less than 0.2 μm and not more than 40 μm, more preferably not less than 1 μm and not more than 35 μm, and still more preferably not less than 5 μm and not more than 30 μm.

An undercoat layer may be provided between the support or electrically conductive layer and the charge generating layer.

The undercoat layer can be formed by forming a coat on the support or electrically conductive layer using a coating solution for an undercoat layer having a resin, and drying or curing the coat.

Examples of the resin for the undercoat layer include polyacrylic acids, methyl cellulose, ethyl cellulose, polyamide resins, polyimide resins, polyamidimide resins, polyamic acid resins, melamine resins, epoxy resins, polyurethane resins, and polyolefin resins. As the resin used for the undercoat layer, thermoplastic resins can be used. Specifically, thermoplastic polyamide resins or polyolefin resins can be used. As the polyamide resins, copolymerized nylons having low crystallinity or non-crystallinity and allowing application in a liquid state can be used. As the polyolefin resins, those in a state where those can be used as a particle dispersion liquid can be used. Further, polyolefin resins can be dispersed in an aqueous medium.

The film thickness of the undercoat layer is preferably not less than 0.05 μm and not more than 30 μm, and more preferably not less than 1 μm and not more than 25 μm. Moreover, the undercoat layer may contain a metal-oxide particle.

Moreover, the undercoat layer may contain a semi-conductive particle, an electron transporting substance, or an electron receiving substance.

A charge generating layer can be provided on the support, the electrically conductive layer or the undercoat layer.

Examples of the charge generating substance used in the electrophotographic photosensitive member include azo pigments, phthalocyanine pigments, indigo pigments and perylene pigments. These charge generating substances may be used alone or in combination. Among these, particularly metal phthalocyanines such as oxytitanium phthalocyanine, hydroxy gallium phthalocyanine, and chlorogallium phthalocyanine have high sensitivity and can be used.

Examples of a binder resin used in the charge generating layer include polycarbonate resins, polyester resins, butyral resins, polyvinylacetal resins, acrylic resins, vinyl acetate resins and urea resins. Among these, particularly butyral resins can be used. These can be used alone, or can be used in combination by mixing or as a copolymer.

The charge generating layer can be formed by forming a coat using a coating solution for a charge generating layer obtained by dispersing the charge generating substance together with a resin and a solvent, and drying the coat. Alternatively, the charge generating layer may be a deposited film of the charge generating substance.

Examples of a dispersing method include methods using a homogenizer, ultrasonic waves, a ball mill, a sand mill, an Attritor, and a roll mill.

The proportion of the charge generating substance to the resin is preferably in the range of 1:10 to 10:1 (mass ratio), and particularly more preferably in the range of 1:1 to 3:1 (mass ratio).

Examples of the solvent used in the coating solution for a charge generating layer include alcohol solvents, sulfoxide solvents, ketone solvents, ether solvents, ester solvents or aromatic hydrocarbon solvents.

The film thickness of the charge generating layer is preferably not less than 0.01 μm and not more than 5 μm, and more preferably not less than 0.1 μm and not more than 2 μm.

Moreover, a variety of a sensitizer, an antioxidant, an ultraviolet absorbing agent, a plasticizer and the like can also be added to the charge generating layer when necessary. In order to prevent stagnation of a flow of charges in the charge generating layer, an electron transporting substance or electron receiving substance may be contained in the charge generating layer.

The electrophotographic photosensitive member can have a charge transporting layer provided on the charge generating layer.

The charge transporting layer is produced by the production method above.

A variety of additives can be added to each of the layers in the electrophotographic photosensitive member. Examples of the additives include deterioration preventing agents such as an antioxidant, an ultraviolet absorbing agent, and a light stabilizer; and fine particles such as organic fine particles and inorganic fine particles. Examples of the deterioration preventing agents include hindered phenol antioxidants, hindered amine light stabilizers, sulfur atom-containing antioxidants, and phosphorus atom-containing antioxidants. Examples of the organic fine particles include molecule resin particles such as fluorine atom-containing resin particles, polystyrene fine particles, and polyethylene resin particles. Examples of the inorganic fine particles include metal oxides such as silica and alumina.

In application of the coating solutions for the respective layers above, coating methods such as a dip coating method, a spray coating method, a spinner coating method, a roller coating method, a Meyer bar coating method, and a blade coating method can be used.

Moreover, a shape of depressions and projections (a shape of depressions, a shape of projections) may be formed on the surface of the charge transporting layer which is a surface layer in the electrophotographic photosensitive member. As a method of forming a shape of depressions and projections, a known method can be used. Examples of the forming method include a method for forming a shape of depressions by spraying polished particles to the surface, a method for forming a shape of depressions and projections by bringing a mold having a shape of depressions and projections into contact with the surface under pressure, and a method for forming a shape of depressions by irradiating the surface with laser light. Among these, a method can be used in which a mold having a shape of depressions and projections is brought into contact with the surface of the surface layer of the electrophotographic photosensitive member under pressure to form a shape of depressions and projections.

Figure 2:
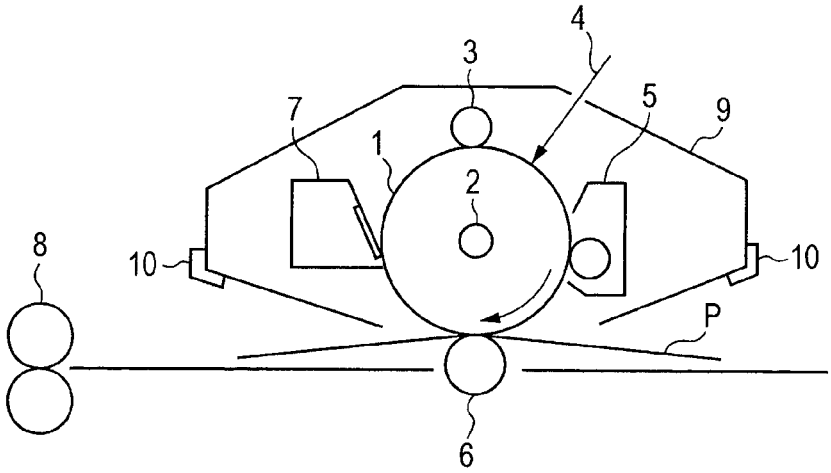
FIG. 2 is a drawing showing an example of a schematic configuration of an electrophotographic apparatus including a process cartridge having the electrophotographic photosensitive member according to the present invention.

FIG. 2 shows an example of a schematic configuration of an electrophotographic apparatus including a process cartridge having the electrophotographic photosensitive member according to the present invention.

In FIG. 2, a cylindrical electrophotographic photosensitive member 1 is shown. The electrophotographic photosensitive member 1 is rotated and driven around a shaft 2 in the arrow direction at a predetermined circumferential speed.

The surface of the electrophotographic photosensitive member 1 rotated and driven is uniformly charged at a positive or negative potential by a charging unit (primary charging unit: charging roller or the like) 3. Next, the surface of the electrophotographic photosensitive member 1 receives expositing light (image expositing light) 4 output from an exposing unit (not shown) such as slit exposure and laser beam scanning exposure. Thus, an electrostatic latent image corresponding to a target image is sequentially formed on the surface of the electrophotographic photosensitive member 1.

The electrostatic latent image formed on the surface of the electrophotographic photosensitive member 1 is developed with a toner included in a developer in a developing unit 5 to form a toner image. Next, the toner image carried on the surface of the electrophotographic photosensitive member 1 is sequentially transferred onto a transfer material (such as paper) P by a transfer bias from a transferring unit (transfer roller or the like) 6. The transfer material P is extracted from a transfer material feeding unit (not shown) and fed to a region between the electrophotographic photosensitive member 1 and the transferring unit 6 (contact region) in synchronization with the rotation of the electrophotographic photosensitive member 1.

The transfer material P to which the toner image is transferred is separated from the surface of the electrophotographic photosensitive member 1, and introduced to a fixing unit 8 to fix the image. Thereby, the transfer material P is printed out to the outside the apparatus as an image forming product (print, copy).

The surface of the electrophotographic photosensitive member 1 after transfer of the toner image is cleaned by removing a transfer remaining developer (toner) by a cleaning unit (cleaning blade or the like) 7. Next, the surface of the electrophotographic photosensitive member 1 is discharged by a pre-expositing light (not shown) from a pre-exposing unit (not shown), and repeatedly used for formation of an image. As shown in FIG. 2, in the case where the charging unit 3 is a contact charging unit using a charging roller, pre-exposure is not always necessary.

Among the components such as the electrophotographic photosensitive member 1, the charging unit 3, the developing unit 5, the transferring unit 6 and the cleaning unit 7, a plurality of the components may be accommodated in a container and integrally formed into a process cartridge, and the process cartridge may be formed attachably to and detachably from the main body of the electrophotographic apparatus such as a copier and a laser beam printer. In FIG. 2, the electrophotographic photosensitive member 1, the charging unit 3, the developing unit 5 and the cleaning unit 7 are integrally supported and formed as a cartridge, and the cartridge is formed as a process cartridge 9 attachably to and detachably from the main body of the electrophotographic apparatus using a guiding unit 10 such as a rail in the main body of the electrophotographic apparatus.

EXAMPLES

Hereinafter, the present invention will be described more in detail using Examples and Comparative Examples. The present invention will not be limited by Examples below. In Examples, "parts" mean "parts by mass."

Example 1

An emulsion was prepared as follows.

3.1 parts of the compound represented by the formula (1-1) and 1.3 parts of the compound represented by the formula (1-5) as the charge transporting substance, and 5.6 parts of a polycarbonate resin having a repeating structure represented by the formula (2-1) (weight average molecular weight Mw=36,000), and 0.1 parts of the compound represented by the formula (A-1) as the resin having a carbonyl group were dissolved in 29.9 parts of toluene to prepare a solution. Next, while 60 parts of ion exchange water (conductivity of 0.2 μS/cm) was stirred by a homogenizer made by MICROTEC CO., LTD. at a rate of 3000 turns/min, 40 parts of the prepared solution was gradually added for 10 minutes. After dropping was completed, the number of rotation of the homogenizer was raised to 7000 rotations and stirring was performed for 20 minutes. Then, the obtained solution was emulsified by a high pressure collision dispersing machine Nanomizer (made by YOSHIDA KIKAI CO., LTD.) on a pressure condition of 150 MPa to obtain an emulsion (100 parts).

The solution stability of the prepared emulsion was evaluated as follows.

After the emulsion was prepared according to the method above, the emulsion was visually evaluated and the particle diameter of the emulsion particle was evaluated. Further, the prepared emulsion was left as it was for 2 weeks (under an environment of the temperature of 23° C. and the humidity of 50% RH). After the state of the emulsion after leaving was observed, the emulsion was stirred at 1,000 turns/min for 3 minutes using a homogenizer made by MICROTEC CO., LTD. The state of the emulsion after stirring was visually observed in the same manner. The average particle diameter of the emulsion particle was measured before and after leaving for 2 weeks and after stirring with the homogenizer, and the particle diameter of the emulsion particle was measured. In the measurement of the average particle diameter of the emulsion particle, the emulsion was diluted with water, and the average particle diameter was measured using an ultracentrifugal automatic particle size distribution analyzer (CAPA700) made by HORIBA, Ltd. The states of the emulsion obtained in Example 1 before and after leaving were not greatly changed even by visually observation. The average particle diameter hardly changed, and the emulsion was kept stably. The results of evaluation of the solution stability are shown in Table 2.

Examples 2 to 15, 19 to 31, 38 to 49, 56 to 64, 67 to 88, 93 to 114, 117 to 136, and 139 to 152

As shown in Tables 3 to 5, an emulsion was prepared in the same method as that in Example 1 except that the kind and ratio of the charge transporting substance and those of the resin having a carbonyl group were changed, and the kind of the solvent and the ratio of the solvent to water were changed. The results of evaluation of solution stability of the obtained emulsions are shown in Tables 7 and 8.

Example 16

As shown in Table 3, an emulsion was prepared in the same method as that in Example 1 except that the kind and ratio of the charge transporting substance, those of the resin having a carbonyl group, and those of the solvent were changed, and 1.5 parts of a surfactant (trade name: NAROACTY CL-85, made by Sanyo Chemical Industries, Ltd., HLB=12.6) was added to 38.5 parts by mass of ion exchange water. The results of evaluation of solution stability of the obtained emulsion are shown in Table 7.

Example 17

As shown in Table 1, an emulsion was prepared in the same method as that in Example 1 except that the kind and ratio of the charge transporting substance, those of the resin having a carbonyl group, and those of the solvent were changed, and 1.5 parts of a surfactant (trade name: EMULGEN MS-110, made by Kao Corporation, HLB=12.7) was added to 38.5 parts by mass of ion exchange water. The results of evaluation of solution stability of the obtained emulsion are shown in Table 7.

Example 18

As shown in Table 3, the kind and ratio of the charge transporting substance, those of the resin having a carbonyl group, and those of the solvent were changed. Further, the ratio of the solvent to water was changed. The charge transporting substance and the resin having a carbonyl group were dissolved in the solvent to prepare a solution. An emulsion was prepared in the same method as that in Example 1 except that 5 parts of the compound (A-1) according to the present invention was added to 45 parts by mass of ion exchange water, mixed with 50 parts by mass of the prepared solution, and stirred. The results of evaluation of solution stability of the obtained emulsion are shown in Table 7.

Examples 32 and 50

An emulsion was prepared in the same method as that in Example 1 except that a polycarbonate resin (Mw=60,000)

having a repeating structural unit represented by the formula (2-3) was used as the resin having a carbonyl group, and the kind and ratio of the charge transporting substance and those of the solvent were changed as shown in Table 3. The results of evaluation of solution stability of the obtained emulsions are shown in Table 7.

Examples 33, 51, 65, 89, 115, and 137

An emulsion was prepared in the same method as that in Example 1 except that a polycarbonate resin having a repeating structural unit represented by the formula (2-2) and a repeating structural unit represented by the formula (2-3) ((2-2)/(2-3)=5/5 (mass ratio), Mw=60,000) was used as the resin having a carbonyl group, and the kind and ratio of the charge transporting substance and those of the solvent were changed as shown in Tables 3 to 5. The results of evaluation of solution stability of the obtained emulsions are shown in Tables 7 and 8.

Examples 34 to 36, 52 to 54, 66, 90, 91, 116, and 138

An emulsion was prepared in the same method as that in Example 1 except that a polyester resin having a repeating structural unit represented by the formula (3-1) and a repeating structural unit represented by the formula (3-2) ((3-1)/(3-2)=5/5 (mass ratio), Mw=90,000)) was used as the resin having a carbonyl group, and the kind and ratio of the charge transporting substance and those of the solvent were changed as shown in Tables 3 to 5. The results of evaluation of solution stability of the obtained emulsions are shown in Tables 7 and 8.

Examples 37, 55, and 92

An emulsion was prepared in the same method as that in Example 1 except that a polyester resin having a repeating structural unit represented by the formula (3-6) (Mw=100,000) was used as the resin having a carbonyl group, and the kind and ratio of the charge transporting substance and those of the solvent were changed as shown in Tables 3 and 4. The results of evaluation of solution stability of the obtained emulsions are shown in Table 7.

Comparative Example 1

A coating solution containing a charge transporting substance and a resin having a carbonyl group was prepared according to the method described in Japanese Patent Application Laid-Open No. 2011-128213 as follows.

3.1 parts of the compound represented by the formula (1-1) and 1.3 parts of the compound represented by the formula (1-5) as the charge transporting substance, and 5.6 parts of a polycarbonate resin having a repeating structural unit represented by the formula (2-1) (Mw=36,000) as the resin having a carbonyl group were dissolved in 40 parts of xylene to prepare 50 parts of the solution. Next, 1.5 parts of a surfactant (trade name: NAROACTY CL-85) was added to 48.5 parts by mass of ion exchange water. While the ion exchange water was stirred at a rate of 3,000 turns/min with a homogenizer, 50 parts of the solution was added, and stirred for 10 minutes. Further, the number of rotation was raised to 7,000 turns/min and stirring was performed for 20 minutes. Then, the obtained solution was emulsified on a pressure condition of 150 MPa using a high pressure collision dispersing machine Nanomizer (made by YOSHIDA KIKAI CO., LTD.) to prepare 100 parts of an emulsion. The solution stability of the obtained emulsion was evaluated in the same method as that in Example 1. The results of evaluation are shown in Table 8.

In the state of the emulsion obtained in Comparative Example 1 immediately after preparation, it was found that emulsion particles were sedimented, part of the emulsion particles coalesced, and aggregates were found on the bottom. In the emulsion after leaving for 2 weeks, aggregation of the emulsion particles was found, and an emulsion having high solution stability could not be formed.

Comparative Examples 2 to 6, and 8

As shown Table 6, an emulsion was prepared in the same method as that in Comparative Example 1 except that the kind and ratio of the charge transporting substance, those of the resin having a carbonyl group, and those of the solvent were changed, and further the ratio of the solvent to water was changed. The results of evaluation of solution stability of the obtained emulsions are shown in Table 8. In the state of the obtained emulsions immediately after preparation, sediment or aggregation of the emulsion particles were found. In the emulsions after leaving for 2 weeks, aggregation of the emulsion particles was found, and the state of the emulsions was not formed in some cases.

Comparative Example 7

As shown Table 6, the kind and ratio of the charge transporting substance, those of the resin having a carbonyl group, and those of the solvent were changed. An emulsion was prepared by the same method as that in Comparative Example 5 except that no surfactant was further added. The results of evaluation of solution stability of the obtained emulsion are shown in Table 8. The solution was quickly separated into an oil phase and an aqueous phase immediately after stirring with a homogenizer, and no emulsion could be prepared.

TABLE 3

| Example | Charge transporting substance (D) and ratio | Resin having a carbonyl group (B) | (D)/(B) ratio | Exemplified compound Structure | Exemplified compound Content (% by mass) | Solvent/Water ratio |
|---|---|---|---|---|---|---|
| 1 | (1-1)/(1-5) = 7/3 | (2-1) | 8/10 | (A-1) | 0.1 | (E-1)/Water = 4/6 |
| 2 | (1-1)/(1-5) = 7/3 | (2-1) | 8/10 | (A-1) | 0.5 | (E-1) Water = 6/4 |
| 3 | (1-1)/(1-5) = 7/3 | (2-1) | 8/10 | (A-1) | 1 | (E-1)/Water = 5/5 |
| 4 | (1-1)/(1-5) = 7/3 | (2-1) | 8/10 | (A-1) | 5 | (E-1)/Water = 4/6 |
| 5 | (1-1)/(1-5) = 7/3 | (2-1) | 8/10 | (A-1) | 10 | (E-1)/Water = 3/7 |
| 6 | (1-1)/(1-5) = 7/3 | (2-1) | 8/10 | (A-1) | 20 | (E-1)/Water = 7/3 |
| 7 | (1-1)/(1-5) = 7/3 | (2-1) | 8/10 | (A-1) | 1 | (E-5)/Water = 6/4 |

TABLE 3-continued

| Example | Charge transporting substance (D) and ratio | Resin having a carbonyl group (B) | (D)/(B) ratio | Exemplified compound Structure | Content (% by mass) | Solvent/Water ratio |
|---|---|---|---|---|---|---|
| 8 | (1-1)/(1-5) = 7/3 | (2-1) | 8/10 | (A-1) | 1 | (E-4)/Water = 4/6 |
| 9 | (1-1)/(1-5) = 7/3 | (2-1) | 8/10 | (A-1) | 1 | (E-2)/Water = 4/6 |
| 10 | (1-1)/(1-5) = 7/3 | (2-1) | 8/10 | (A-1) | 1 | (E-3)/Water = 4/6 |
| 11 | (1-1)/(1-5) = 7/3 | (2-1) | 8/10 | (A-1) | 1 | (E-6)/Water = 4/6 |
| 12 | (1-1)/(1-5) = 7/3 | (2-1) | 8/10 | (A-1) | 1 | (E-7)/Water = 4/6 |
| 13 | (1-1)/(1-5) = 7/3 | (2-1) | 8/10 | (A-1) | 1 | (E-5)/(F-2)/Water = 2/2/6 |
| 14 | (1-1)/(1-5) = 7/3 | (2-1) | 8/10 | (A-1) | 1 | (E-1)/(F-2)/Water = 2/2/6 |
| 15 | (1-1)/(1-5) = 7/3 | (2-1) | 8/10 | (A-1) | 1 | (E-1)/(F-1)/Water = 2/2/6 |
| 16 | (1-1)/(1-5) = 7/3 | (2-1) | 8/10 | (A-1)/(A-2) | 0.5/0.5 | (E-1)/Water = 4/6 |
| 17 | (1-1)/(1-5) = 7/3 | (2-1) | 8/10 | (A-1) | 1 | (E-5)/(F-2)/Water = 2/2/6 |
| 18 | (1-1)/(1-5) = 7/3 | (2-1) | 8/10 | (A-1) | 5 | (E-1)/Water = 5/5 |
| 19 | (1-1)/(1-5) = 7/3 | (2-1) | 9/10 | (A-1) | 5 | (E-1)/Water = 4/6 |
| 20 | (1-1)/(1-5) = 7/3 | (2-1) | 10/10 | (A-1) | 5 | (E-1)/Water = 3/7 |
| 21 | (1-1)/(1-5) = 7/3 | (2-1) | 7/10 | (A-1) | 5 | (E-1)/Water = 7/3 |
| 22 | (1-1)/(1-5) = 7/3 | (2-1) | 12/10 | (A-1) | 5 | (E-1)/Water = 4/6 |
| 23 | (1-1)/(1-5) = 9/1 | (2-1) | 9/10 | (A-1) | 5 | (E-1)/Water = 4/6 |
| 24 | (1-1)/(1-5) = 8/2 | (2-1) | 10/10 | (A-1) | 5 | (E-1)/Water = 4/6 |
| 25 | (1-1)/(1-5) = 6/4 | (2-1) | 7/10 | (A-1) | 5 | (E-1)/Water = 4/6 |
| 26 | (1-1)/(1-5) = 5/5 | (2-1) | 12/10 | (A-1) | 5 | (E-1)/Water = 4/6 |
| 27 | (1-1)/(1-9) = 7/3 | (2-1) | 8/10 | (A-1) | 5 | (E-1)/Water = 4/6 |
| 28 | (1-1)/(1-9) = 9/1 | (2-1) | 8/10 | (A-1) | 5 | (E-1)/Water = 4/6 |
| 29 | (1-1) | (2-1) | 8/10 | (A-1) | 5 | (E-1)/Water = 4/6 |
| 30 | (1-5) | (2-1) | 9/10 | (A-1) | 5 | (E-1)/Water = 4/6 |
| 31 | (1-9) | (2-1) | 8/10 | (A-1) | 5 | (E-1)/Water = 4/6 |
| 32 | (1-1) | (2-3) | 10/10 | (A-1) | 5 | (E-1)/Water = 4/6 |
| 33 | (1-1) | (2-1)/(2-3) = 5/5 | 10/10 | (A-1) | 5 | (E-1)/Water = 4/6 |
| 34 | (1-1) | (3-1)/(3-2) = 5/5 | 8/10 | (A-1) | 5 | (E-1)/Water = 4/6 |
| 35 | (1-5) | (3-1)/(3-2) = 5/5 | 9/10 | (A-1) | 5 | (E-1)/Water = 4/6 |
| 36 | (1-9) | (3-1)/(3-2) = 5/5 | 8/10 | (A-1) | 5 | (E-1)/Water = 4/6 |
| 37 | (1-1) | (3-6) | 8/10 | (A-1) | 5 | (E-1)/Water = 4/6 |
| 38 | (1-1)/(1-5) = 7/3 | (2-1) | 8/10 | (A-2) | 0.1 | (E-1)/Water = 4/6 |
| 39 | (1-1)/(1-5) = 7/3 | (2-1) | 8/10 | (A-2) | 1 | (E-1)/Water = 4/6 |
| 40 | (1-1)/(1-5) = 7/3 | (2-1) | 8/10 | (A-2) | 20 | (E-1)/Water = 4/6 |
| 41 | (1-1)/(1-5) = 9/1 | (2-1) | 8/10 | (A-2) | 5 | (E-1)/Water = 4/6 |
| 42 | (1-1)/(1-5) = 8/2 | (2-1) | 8/10 | (A-2) | 5 | (E-1)/Water = 4/6 |
| 43 | (1-1)/(1-5) = 5/5 | (2-1) | 8/10 | (A-2) | 5 | (E-1)/Water = 4/6 |
| 44 | (1-1)/(1-5) = 8/2 | (2-1) | 10/10 | (A-2) | 5 | (E-1)/Water = 4/6 |
| 45 | (1-1)/(1-5) = 8/2 | (2-1) | 7/10 | (A-2) | 5 | (E-1)/Water = 4/6 |
| 46 | (1-1)/(1-5) = 8/2 | (2-1) | 9/10 | (A-2) | 5 | (E-1)/Water = 4/6 |
| 47 | (1-1)/(1-9) = 8/2 | (2-1) | 8/10 | (A-2) | 5 | (E-1)/Water = 4/6 |
| 48 | (1-5) | (2-1) | 9/10 | (A-2) | 5 | (E-1)/Water = 4/6 |
| 49 | (1-9) | (2-1) | 8/10 | (A-2) | 5 | (E-1)/Water = 4/6 |
| 50 | (1-1) | (2-3) | 10/10 | (A-2) | 5 | (E-1)/Water = 4/6 |
| 51 | (1-1) | (2-1)/(2-3) = 5/5 | 10/10 | (A-2) | 5 | (E-1)/Water = 4/6 |
| 52 | (1-1) | (3-1)/(3-2) = 5/5 | 8/10 | (A-2) | 5 | (E-1)/Water = 4/6 |
| 53 | (1-5) | (3-1)/(3-2) = 5/5 | 9/10 | (A-2) | 5 | (E-1)/Water = 4/6 |
| 54 | (1-9) | (3-1)/(3-2) = 5/5 | 8/10 | (A-2) | 5 | (E-1)/Water = 4/6 |
| 55 | (1-1) | (3-6) | 8/10 | (A-2) | 5 | (E-1)/Water = 4/6 |

TABLE 4

| Example | Charge transporting substance (D) and ratio | Resin having a carbonyl group (B) | (D)/(B) ratio | Exemplified compound Structure | Content (% by mass) | Solvent/Water ratio |
|---|---|---|---|---|---|---|
| 56 | (1-1)/(1-5) = 7/3 | (2-1) | 8/10 | (A-3) | 0.1 | (E-1)/Water = 5/5 |
| 57 | (1-1)/(1-5) = 7/3 | (2-1) | 8/10 | (A-3) | 1 | (E-1)/Water = 4/6 |
| 58 | (1-1)/(1-5) = 7/3 | (2-1) | 8/10 | (A-3) | 20 | (E-1)/Water = 3/7 |
| 59 | (1-1)/(1-5) = 9/1 | (2-1) | 8/10 | (A-3) | 5 | (E-1)/Water = 7/3 |
| 60 | (1-1)/(1-5) = 5/5 | (2-1) | 8/10 | (A-3) | 5 | (E-1)/Water = 4/6 |
| 61 | (1-1)/(1-5) = 8/2 | (2-1) | 10/10 | (A-3) | 5 | (E-1)/Water = 4/6 |
| 62 | (1-1)/(1-5) = 8/2 | (2-1) | 7/10 | (A-3) | 5 | (E-1)/Water = 4/6 |
| 63 | (1-1)/(1-9) = 8/2 | (2-1) | 8/10 | (A-3) | 5 | (E-1)/Water = 4/6 |
| 64 | (1-9) | (2-1) | 8/10 | (A-3) | 5 | (E-1)/Water = 4/6 |
| 65 | (1-1) | (2-1)/(2-3) = 5/5 | 10/10 | (A-3) | 5 | (E-1)/Water = 4/6 |
| 66 | (1-1) | (3-1)/(3-2) = 5/5 | 8/10 | (A-3) | 5 | (E-1)/Water = 4/6 |
| 67 | (1-1)/(1-5) = 7/3 | (2-1) | 9/10 | (A-4) | 0.1 | (E-1)/Water = 4/6 |
| 68 | (1-1)/(1-5) = 7/3 | (2-1) | 9/10 | (A-4) | 1 | (E-1)/Water = 4/6 |
| 69 | (1-1)/(1-5) = 7/3 | (2-1) | 9/10 | (A-4) | 20 | (E-1)/Water = 4/6 |

TABLE 4-continued

| Example | Charge transporting substance (D) and ratio | Resin having a carbonyl group (B) | (D)/(B) ratio | Exemplified compound Structure | Exemplified compound Content (% by mass) | Solvent/Water ratio |
|---|---|---|---|---|---|---|
| 70 | (1-1)/(1-5) = 7/3 | (2-1) | 9/10 | (A-5) | 1 | (E-1)/Water = 4/6 |
| 71 | (1-1)/(1-5) = 7/3 | (2-1) | 9/10 | (A-6) | 1 | (E-1)/Water = 4/6 |
| 72 | (1-1)/(1-5) = 7/3 | (2-1) | 9/10 | (A-7) | 5 | (E-1)/Water = 4/6 |
| 73 | (1-1)/(1-5) = 7/3 | (2-1) | 9/10 | (A-8) | 5 | (E-1)/Water = 4/6 |
| 74 | (1-1)/(1-5) = 7/3 | (2-1) | 9/10 | (A-9) | 5 | (E-1)/Water = 5/5 |
| 75 | (1-1)/(1-5) = 7/3 | (2-1) | 9/10 | (A-10) | 5 | (E-1)/Water = 4/6 |
| 76 | (1-1)/(1-5) = 7/3 | (2-1) | 9/10 | (A-11) | 5 | (E-1)/Water = 3/7 |
| 77 | (1-1)/(1-5) = 7/3 | (2-1) | 9/10 | (A-12) | 5 | (E-1)/Water = 7/3 |
| 78 | (1-1)/(1-5) = 7/3 | (2-1) | 9/10 | (A-13) | 5 | (E-1)Water = 6/4 |
| 79 | (1-1)/(1-5) = 7/3 | (2-1) | 9/10 | (A-14) | 5 | (E-1)Water = 6/4 |
| 80 | (1-1)/(1-5) = 7/3 | (2-1) | 9/10 | (B-1) | 0.1 | (E-1)/Water = 4/6 |
| 81 | (1-1)/(1-5) = 7/3 | (2-1) | 9/10 | (B-1) | 1 | (E-1)/Water = 4/6 |
| 82 | (1-1)/(1-5) = 7/3 | (2-1) | 9/10 | (B-1) | 20 | (E-1)/Water = 4/6 |
| 83 | (1-1)/(1-5) = 9/1 | (2-1) | 9/10 | (B-1) | 5 | (E-1)/Water = 5/5 |
| 84 | (1-1)/(1-5) = 5/5 | (2-1) | 9/10 | (B-1) | 5 | (E-1)/Water = 4/6 |
| 85 | (1-1)/(1-5) = 8/2 | (2-1) | 10/10 | (B-1) | 5 | (E-1)/Water = 3/7 |
| 86 | (1-1)/(1-5) = 8/2 | (2-1) | 7/10 | (B-1) | 5 | (E-1)/Water = 7/3 |
| 87 | (1-1)/(1-9) = 8/2 | (2-1) | 9/10 | (B-1) | 5 | (E-1)/Water = 4/6 |
| 88 | (1-9) | (2-1) | 9/10 | (B-1) | 5 | (E-1)/Water = 4/6 |
| 89 | (1-1) | (2-1)/(2-3) = 5/5 | 10/10 | (B-1) | 5 | (E-1)/Water = 4/6 |
| 90 | (1-1) | (3-1)/(3-2) = 5/5 | 8/10 | (B-1) | 5 | (E-1)/Water = 4/6 |
| 91 | (1-9) | (3-1)/(3-2) = 5/5 | 8/10 | (B-1) | 5 | (E-1)/Water = 4/6 |
| 92 | (1-1) | (3-6) | 8/10 | (B-1) | 5 | (E-1)/Water = 4/6 |
| 93 | (1-1)/(1-9) = 8/2 | (2-1) | 9/10 | (B-2) | 1 | (E-1)/Water = 4/6 |
| 94 | (1-1)/(1-5) = 9/1 | (2-1) | 9/10 | (B-2) | 1 | (E-1)/Water = 4/6 |
| 95 | (1-1)/(1-5) = 5/5 | (2-1) | 9/10 | (B-2) | 1 | (E-1)/Water = 4/6 |
| 96 | (1-1)/(1-5) = 8/2 | (2-1) | 10/10 | (B-3) | 0.1 | (E-1)/Water = 4/6 |
| 97 | (1-1)/(1-5) = 9/1 | (2-1) | 7/10 | (B-3) | 0.1 | (E-1)/Water = 4/6 |
| 98 | (1-1)/(1-5) = 5/5 | (2-1) | 8/10 | (B-3) | 0.1 | (E-1)/Water = 4/6 |
| 99 | (1-1)/(1-5) = 8/2 | (2-1) | 9/10 | (B-3) | 0.5 | (E-1)/Water = 4/6 |
| 100 | (1-1)/(1-5) = 8/2 | (2-1) | 9/10 | (B-3) | 5 | (E-1)/Water = 4/6 |
| 101 | (1-1)/(1-5) = 8/2 | (2-1) | 9/10 | (B-3) | 10 | (E-1)/Water = 4/6 |
| 102 | (1-1)/(1-5) = 8/2 | (2-1) | 9/10 | (B-4) | 0.1 | (E-1)/Water = 4/6 |
| 103 | (1-1)/(1-5) = 9/1 | (2-1) | 9/10 | (B-4) | 0.1 | (E-1)/Water = 4/6 |
| 104 | (1-1)/(1-5) = 5/5 | (2-1) | 9/10 | (B-4) | 1 | (E-1)/Water = 4/6 |
| 105 | (1-1)/(1-5) = 7/3 | (2-1) | 9/10 | (B-4) | 20 | (E-1)/Water = 4/6 |

TABLE 5

| Example | Charge transporting substance (D) and ratio | Resin having a carbonyl group (B) | (D)/(B) ratio | Exemplified compound Structure | Exemplified compound Content (% by mass) | Solvent/Water ratio |
|---|---|---|---|---|---|---|
| 106 | (1-1)/(1-5) = 7/3 | (2-1) | 8/10 | (C-1) | 0.1 | (E-1)/Water = 4/6 |
| 107 | (1-1)/(1-5) = 7/3 | (2-1) | 8/10 | (C-1) | 1 | (E-1)/Water = 4/6 |
| 108 | (1-1)/(1-5) = 7/3 | (2-1) | 8/10 | (C-1) | 20 | (E-1)/Water = 4/6 |
| 109 | (1-1)/(1-5) = 9/1 | (2-1) | 8/10 | (C-1) | 5 | (E-1)/Water = 4/6 |
| 110 | (1-1)/(1-5) = 5/5 | (2-1) | 8/10 | (C-1) | 5 | (E-1)/Water = 4/6 |
| 111 | (1-1)/(1-5) = 8/2 | (2-1) | 10/10 | (C-1) | 5 | (E-1)/Water = 4/6 |
| 112 | (1-1)/(1-5) = 8/2 | (2-1) | 7/10 | (C-1) | 5 | (E-1)/Water = 4/6 |
| 113 | (1-1)/(1-9) = 8/2 | (2-1) | 8/10 | (C-1) | 5 | (E-1)/Water = 4/6 |
| 114 | (1-9) | (2-1) | 8/10 | (C-1) | 5 | (E-1)/Water = 4/6 |
| 115 | (1-1) | (2-1)/(2-3) = 5/5 | 10/10 | (C-1) | 5 | (E-1)/Water = 4/6 |
| 116 | (1-1) | (3-1)/(3-2) = 5/5 | 8/10 | (C-1) | 5 | (E-1)/Water = 4/6 |
| 117 | (1-1)/(1-5) = 7/3 | (2-1) | 9/10 | (C-2) | 0.1 | (E-1)/Water = 4/6 |
| 118 | (1-1)/(1-5) = 7/3 | (2-1) | 9/10 | (C-3) | 1 | (E-1)/Water = 4/6 |
| 119 | (1-1)/(1-5) = 7/3 | (2-1) | 9/10 | (C-4) | 20 | (E-1)/Water = 4/6 |
| 120 | (1-1)/(1-5) = 7/3 | (2-1) | 9/10 | (C-5) | 1 | (E-1)/Water = 4/6 |
| 121 | (1-1)/(1-5) = 7/3 | (2-1) | 9/10 | (C-6) | 1 | (E-1)/Water = 4/6 |
| 122 | (1-1)/(1-5) = 7/3 | (2-1) | 9/10 | (C-7) | 5 | (E-1)/Water = 4/6 |
| 123 | (1-1)/(1-5) = 7/3 | (2-1) | 9/10 | (C-8) | 5 | (E-1)/Water = 4/6 |
| 124 | (1-1)/(1-5) = 7/3 | (2-1) | 9/10 | (C-9) | 5 | (E-1)/Water = 4/6 |
| 125 | (1-1)/(1-5) = 7/3 | (2-1) | 9/10 | (C-10) | 5 | (E-1)/Water = 4/6 |
| 126 | (1-1)/(1-5) = 7/3 | (2-1) | 9/10 | (C-11) | 5 | (E-1)/Water = 4/6 |
| 127 | (1-1)/(1-5) = 7/3 | (2-1) | 9/10 | (C-12) | 5 | (E-1)/Water = 4/6 |
| 128 | (1-1)/(1-5) = 7/3 | (2-1) | 8/10 | (D-1) | 0.1 | (E-1)/Water = 4/6 |
| 129 | (1-1)/(1-5) = 7/3 | (2-1) | 8/10 | (D-1) | 1 | (E-1)/Water = 4/6 |
| 130 | (1-1)/(1-5) = 7/3 | (2-1) | 8/10 | (D-1) | 20 | (E-1)/Water = 4/6 |
| 131 | (1-1)/(1-5) = 9/1 | (2-1) | 8/10 | (D-1) | 0.5 | (E-1)/Water = 4/6 |

TABLE 5-continued

| Example | Charge transporting substance (D) and ratio | Resin having a carbonyl group (B) | (D)/(B) ratio | Exemplified compound Structure | Exemplified compound Content (% by mass) | Solvent/Water ratio |
|---|---|---|---|---|---|---|
| 132 | (1-1)/(1-5) = 5/5 | (2-1) | 8/10 | (D-1) | 5 | (E-1)/Water = 4/6 |
| 133 | (1-1)/(1-5) = 8/2 | (2-1) | 10/10 | (D-1) | 5 | (E-1)/Water = 4/6 |
| 134 | (1-1)/(1-5) = 8/2 | (2-1) | 7/10 | (D-1) | 5 | (E-1)/Water = 4/6 |
| 135 | (1-1)/(1-9) = 8/2 | (2-1) | 8/10 | (D-1) | 5 | (E-1)/Water = 4/6 |
| 136 | (1-9) | (2-1) | 8/10 | (D-1) | 5 | (E-1)/Water = 4/6 |
| 137 | (1-1) | (2-1)/(2-3) = 5/5 | 10/10 | (D-1) | 5 | (E-1)/Water = 4/6 |
| 138 | (1-1) | (3-1)/(3-2) = 5/5 | 8/10 | (D-2) | 5 | (E-1)/Water = 4/6 |
| 139 | (1-1)/(1-5) = 7/3 | (2-1) | 9/10 | (D-3) | 0.1 | (E-1)/Water = 4/6 |
| 140 | (1-1)/(1-5) = 7/3 | (2-1) | 9/10 | (D-4) | 1 | (E-1)/Water = 4/6 |
| 141 | (1-1)/(1-5) = 7/3 | (2-1) | 9/10 | (D-5) | 20 | (E-1)/Water = 4/6 |
| 142 | (1-1)/(1-5) = 7/3 | (2-1) | 9/10 | (D-6) | 1 | (E-1)/Water = 4/6 |
| 143 | (1-1)/(1-5) = 7/3 | (2-1) | 9/10 | (D-7) | 1 | (E-1)/Water = 4/6 |
| 144 | (1-1)/(1-5) = 7/3 | (2-1) | 9/10 | (D-8) | 0.1 | (E-1)/Water = 4/6 |
| 145 | (1-1)/(1-5) = 7/3 | (2-1) | 9/10 | (D-9) | 0.1 | (E-1)/Water = 4/6 |
| 146 | (1-1)/(1-5) = 7/3 | (2-1) | 9/10 | (D-10) | 0.1 | (E-1)/Water = 4/6 |
| 147 | (1-1)/(1-5) = 7/3 | (2-1) | 9/10 | (D-11) | 0.1 | (E-1)/Water = 4/6 |
| 148 | (1-1)/(1-5) = 7/3 | (2-1) | 9/10 | (D-12) | 0.1 | (E-1)/Water = 4/6 |
| 149 | (1-1)/(1-5) = 7/3 | (2-1) | 9/10 | (E-1) | 0.1 | (E-1)/Water = 4/6 |
| 150 | (1-1)/(1-5) = 9/1 | (2-1) | 9/10 | (E-2) | 0.1 | (E-1)/Water = 4/6 |
| 151 | (1-1)/(1-5) = 5/5 | (2-1) | 9/10 | (E-3) | 0.1 | (E-1)/Water = 4/6 |
| 152 | (1-1)/(1-5) = 7/3 | (2-1) | 9/10 | (E-3) | 0.1 | (E-1)/Water = 4/6 |

TABLE 6

| Comparative Example | Charge transporting substance (D) and ratio | Resin having a carbonyl group (B) | (D)/(B) ratio | Surfactant content | Exemplified compound | Solvent/water ratio |
|---|---|---|---|---|---|---|
| 1 | (1-1)/(1-5) = 7/3 | (2-1) | 8/10 | 1.5% by mass | — | (E-5)/Water = 5/5 |
| 2 | (1-1)/(1-5) = 7/3 | (2-1) | 8/10 | 1.5% by mass | — | (E-4)/Water = 4/6 |
| 3 | (1-1)/(1-5) = 7/3 | (2-1) | 8/10 | 1.5% by mass | — | (E-1)/Water = 3/7 |
| 4 | (1-1)/(1-5) = 7/3 | (2-1) | 8/10 | 1.5% by mass | — | (E-1)/Water = 7/3 |
| 5 | (1-1) | (3-1)/(3-2) = 5/5 | 8/10 | 1.5% by mass | — | (E-1)/Water = 6/4 |
| 6 | (1-1)/(1-5) = 5/5 | (2-1) | 8/10 | 1.5% by mass | — | (E-1)/Water = 5/5 |
| 7 | (1-1)/(1-5) = 7/3 | (2-1) | 8/10 | — | — | (E-1)/Water = 6/4 |
| 8 | (1-1) | (3-1)/(3-2) = 5/5 | 8/10 | 1.5% by mass | — | (E-5)/Water = 6/4 |

In Tables 3 to 6, the "(D)/(B) ratio" designates the mass ratio of the charge transporting substance to the resin having a carbonyl group. The "Surfactant content" designates the content of the surfactant based on the total mass of the emulsion (% by mass).

TABLE 7

| Example | Evaluation of solution stability: Immediately after preparation: Visual observation | Immediately after preparation: Average particle diameter | Leaving for 2 weeks and stirring: Visual observation | Leaving for 2 weeks and stirring: Average particle diameter |
|---|---|---|---|---|
| 1 | Uniform and semi-transparent | 2.5 μm | Uniform and semi-transparent | 2.7 μm |
| 2 | Uniform and semi-transparent | 2.8 μm | Uniform and semi-transparent | 3.4 μm |
| 3 | Uniform and semi-transparent | 2.7 μm | Uniform and semi-transparent | 2.9 μm |
| 4 | Uniform and transparent | 0.8 μm | Uniform and transparent | 1.1 μm |
| 5 | Uniform and transparent | 0.7 μm | Uniform and transparent | 0.8 μm |

TABLE 7-continued

| Example | Evaluation of solution stability: Immediately after preparation: Visual observation | Immediately after preparation: Average particle diameter | Leaving for 2 weeks and stirring: Visual observation | Leaving for 2 weeks and stirring: Average particle diameter |
|---|---|---|---|---|
| 6 | Uniform and transparent | 0.9 μm | Uniform and transparent | 1.8 μm |
| 7 | Uniform and semi-transparent | 2.4 μm | Uniform and semi-transparent | 2.9 μm |
| 8 | Uniform and semi-transparent | 2.5 μm | Uniform and semi-transparent | 2.8 μm |
| 9 | Uniform and semi-transparent | 2.3 μm | Uniform and semi-transparent | 2.7 μm |
| 10 | Uniform and semi-transparent | 2.5 μm | Uniform and semi-transparent | 2.7 μm |
| 11 | Uniform and semi-transparent | 2.8 μm | Uniform and semi-transparent | 2.8 μm |
| 12 | Uniform and semi-transparent | 2.3 μm | Uniform and semi-transparent | 2.7 μm |
| 13 | Uniform and semi-transparent | 2.7 μm | Uniform and semi-transparent | 2.9 μm |
| 14 | Uniform and semi-transparent | 2.5 μm | Uniform and semi-transparent | 2.8 μm |

TABLE 7-continued

| Example | Evaluation of solution stability: Immediately after preparation: Visual observation | Immediately after preparation: Average particle diameter | Leaving for 2 weeks and stirring: Visual observation | Leaving for 2 weeks and stirring: Average particle diameter |
|---|---|---|---|---|
| 15 | Uniform and semi-transparent | 2.6 μm | Uniform and semi-transparent | 2.7 μm |
| 16 | Uniform and transparent | 1.2 μm | Uniform and transparent | 1.4 μm |
| 17 | Uniform and transparent | 1.1 μm | Uniform and transparent | 1.3 μm |
| 18 | Uniform and transparent | 0.8 μm | Uniform and transparent | 1.1 μm |
| 19 | Uniform and transparent | 0.7 μm | Uniform and transparent | 0.8 μm |
| 20 | Uniform and transparent | 0.9 μm | Uniform and transparent | 1.0 μm |
| 21 | Uniform and transparent | 1.1 μm | Uniform and transparent | 1.9 μm |
| 22 | Uniform and transparent | 1.2 μm | Uniform and transparent | 1.4 μm |
| 23 | Uniform and transparent | 1.0 μm | Uniform and transparent | 1.3 μm |
| 24 | Uniform and transparent | 1.1 μm | Uniform and transparent | 1.3 μm |
| 25 | Uniform and transparent | 1.2 μm | Uniform and transparent | 1.4 μm |
| 26 | Uniform and transparent | 1.0 μm | Uniform and transparent | 1.3 μm |
| 27 | Uniform and transparent | 1.1 μm | Uniform and transparent | 1.3 μm |
| 28 | Uniform and transparent | 1.3 μm | Uniform and transparent | 1.4 μm |
| 29 | Uniform and transparent | 1.2 μm | Uniform and transparent | 1.3 μm |
| 30 | Uniform and transparent | 1.1 μm | Uniform and transparent | 1.2 μm |
| 31 | Uniform and transparent | 1.5 μm | Uniform and transparent | 1.6 μm |
| 32 | Uniform and transparent | 1.0 μm | Uniform and transparent | 1.3 μm |
| 33 | Uniform and transparent | 1.1 μm | Uniform and transparent | 1.3 μm |
| 34 | Uniform and transparent | 1.3 μm | Uniform and transparent | 1.4 μm |
| 35 | Uniform and transparent | 1.4 μm | Uniform and transparent | 1.4 μm |
| 36 | Uniform and transparent | 1.3 μm | Uniform and transparent | 1.3 μm |
| 37 | Uniform and transparent | 1.6 μm | Uniform and transparent | 1.6 μm |
| 38 | Uniform and semi-transparent | 2.7 μm | Uniform and semi-transparent | 2.7 μm |
| 39 | Uniform and semi-transparent | 2.7 μm | Uniform and semi-transparent | 2.9 μm |
| 40 | Uniform and transparent | 0.8 μm | Uniform and transparent | 1.1 μm |
| 41 | Uniform and transparent | 1.2 μm | Uniform and transparent | 1.4 μm |
| 42 | Uniform and transparent | 1.0 μm | Uniform and transparent | 1.3 μm |
| 43 | Uniform and transparent | 1.1 μm | Uniform and transparent | 1.3 μm |
| 44 | Uniform and transparent | 1.3 μm | Uniform and transparent | 1.4 μm |
| 45 | Uniform and transparent | 1.2 μm | Uniform and transparent | 1.3 μm |
| 46 | Uniform and transparent | 1.1 μm | Uniform and transparent | 1.2 μm |
| 47 | Uniform and transparent | 1.5 μm | Uniform and transparent | 1.6 μm |
| 48 | Uniform and transparent | 1.0 μm | Uniform and transparent | 1.3 μm |
| 49 | Uniform and transparent | 1.1 μm | Uniform and transparent | 1.3 μm |

TABLE 7-continued

| Example | Evaluation of solution stability: Immediately after preparation: Visual observation | Immediately after preparation: Average particle diameter | Leaving for 2 weeks and stirring: Visual observation | Leaving for 2 weeks and stirring: Average particle diameter |
|---|---|---|---|---|
| 50 | Uniform and transparent | 1.3 μm | Uniform and transparent | 1.4 μm |
| 51 | Uniform and transparent | 1.4 μm | Uniform and transparent | 1.5 μm |
| 52 | Uniform and transparent | 1.3 μm | Uniform and transparent | 1.4 μm |
| 53 | Uniform and transparent | 1.6 μm | Uniform and transparent | 1.7 μm |
| 54 | Uniform and transparent | 1.3 μm | Uniform and transparent | 1.4 μm |
| 55 | Uniform and transparent | 1.4 μm | Uniform and transparent | 1.5 μm |
| 56 | Uniform and semi-transparent | 2.7 μm | Uniform and semi-transparent | 2.7 μm |
| 57 | Uniform and semi-transparent | 2.7 μm | Uniform and semi-transparent | 2.9 μm |
| 58 | Uniform and transparent | 0.8 μm | Uniform and transparent | 1.1 μm |
| 59 | Uniform and transparent | 1.2 μm | Uniform and transparent | 2.0 μm |
| 60 | Uniform and transparent | 1.0 μm | Uniform and transparent | 1.3 μm |
| 61 | Uniform and transparent | 1.1 μm | Uniform and transparent | 1.3 μm |
| 62 | Uniform and transparent | 1.3 μm | Uniform and transparent | 1.4 μm |
| 63 | Uniform and transparent | 1.2 μm | Uniform and transparent | 1.3 μm |
| 64 | Uniform and transparent | 1.1 μm | Uniform and transparent | 1.2 μm |
| 65 | Uniform and transparent | 1.5 μm | Uniform and transparent | 1.6 μm |
| 66 | Uniform and transparent | 1.0 μm | Uniform and transparent | 1.3 μm |
| 67 | Uniform and semi-transparent | 2.7 μm | Uniform and semi-transparent | 2.7 μm |
| 68 | Uniform and semi-transparent | 2.7 μm | Uniform and semi-transparent | 2.9 μm |
| 69 | Uniform and transparent | 0.8 μm | Uniform and transparent | 1.1 μm |
| 70 | Uniform and semi-transparent | 2.7 μm | Uniform and semi-transparent | 2.9 μm |
| 71 | Uniform and semi-transparent | 2.7 μm | Uniform and semi-transparent | 2.9 μm |
| 72 | Uniform and transparent | 1.1 μm | Uniform and transparent | 1.3 μm |
| 73 | Uniform and transparent | 1.3 μm | Uniform and transparent | 1.4 μm |
| 74 | Uniform and transparent | 1.2 μm | Uniform and transparent | 1.3 μm |
| 75 | Uniform and transparent | 1.1 μm | Uniform and transparent | 1.2 μm |
| 76 | Uniform and transparent | 1.5 μm | Uniform and transparent | 1.6 μm |
| 77 | Uniform and transparent | 1.0 μm | Uniform and transparent | 1.8 μm |
| 78 | Uniform and transparent | 1.1 μm | Uniform and transparent | 1.9 μm |
| 79 | Uniform and transparent | 1.5 μm | Uniform and transparent | 1.6 μm |
| 80 | Uniform blue white | 7.2 μm | Uniform blue white | 7.5 μm |
| 81 | Uniform blue white | 5.8 μm | Uniform blue white | 6.0 μm |
| 82 | Uniform and semi-transparent | 4.2 μm | Uniform and semi-transparent | 4.4 μm |
| 83 | Uniform and semi-transparent | 4.6 μm | Uniform and semi-transparent | 4.8 μm |
| 84 | Uniform and semi-transparent | 4.8 μm | Uniform and semi-transparent | 4.9 μm |

TABLE 7-continued

| Example | Evaluation of solution stability: Immediately after preparation: Visual observation | Immediately after preparation: Average particle diameter | Leaving for 2 weeks and stirring: Visual observation | Leaving for 2 weeks and stirring: Average particle diameter |
|---|---|---|---|---|
| 85 | Uniform and semi-transparent | 4.9 μm | Uniform and semi-transparent | 5.1 μm |
| 86 | Uniform and semi-transparent | 4.8 μm | Uniform blue white | 6.0 μm |
| 87 | Uniform and semi-transparent | 4.7 μm | Uniform and semi-transparent | 4.9 μm |
| 88 | Uniform and semi-transparent | 4.9 μm | Uniform and semi-transparent | 5.1 μm |
| 89 | Uniform and semi-transparent | 4.8 μm | Uniform and semi-transparent | 5.0 μm |
| 90 | Uniform and semi-transparent | 4.8 μm | Uniform and semi-transparent | 5.0 μm |
| 91 | Uniform and semi-transparent | 4.7 μm | Uniform and semi-transparent | 4.9 μm |
| 92 | Uniform and semi-transparent | 4.8 μm | Uniform and semi-transparent | 5.0 μm |
| 93 | Uniform and semi-transparent | 2.7 μm | Uniform and semi-transparent | 2.9 μm |
| 94 | Uniform and semi-transparent | 2.7 μm | Uniform and semi-transparent | 2.9 μm |
| 95 | Uniform and semi-transparent | 2.7 μm | Uniform and semi-transparent | 2.9 μm |
| 96 | Uniform and semi-transparent | 3.7 μm | Uniform and semi-transparent | 3.9 μm |
| 97 | Uniform and semi-transparent | 3.5 μm | Uniform and semi-transparent | 3.6 μm |
| 98 | Uniform and semi-transparent | 3.7 μm | Uniform and semi-transparent | 3.8 μm |
| 99 | Uniform and semi-transparent | 3.2 μm | Uniform and semi-transparent | 3.3 μm |
| 100 | Uniform and semi-transparent | 2.7 μm | Uniform and semi-transparent | 2.9 μm |
| 101 | Uniform and semi-transparent | 2.2 μm | Uniform and semi-transparent | 2.3 μm |
| 102 | Uniform and semi-transparent | 3.7 μm | Uniform and semi-transparent | 3.8 μm |
| 103 | Uniform and semi-transparent | 3.7 μm | Uniform and semi-transparent | 3.8 μm |
| 104 | Uniform and semi-transparent | 3.2 μm | Uniform and semi-transparent | 3.3 μm |
| 105 | Uniform and semi-transparent | 2.0 μm | Uniform and semi-transparent | 2.1 μm |

TABLE 8

| Example | Evaluation of solution stability: Immediately after preparation: Visual observation | Immediately after preparation: Average particle diameter | Leaving for 2 weeks and stirring: Visual observation | Leaving for 2 weeks and stirring: Average particle diameter |
|---|---|---|---|---|
| 106 | Uniform and semi-transparent | 2.7 μm | Uniform and semi-transparent | 2.7 μm |
| 107 | Uniform and semi-transparent | 2.7 μm | Uniform and semi-transparent | 2.9 μm |
| 108 | Uniform and transparent | 0.8 μm | Uniform and transparent | 1.1 μm |
| 109 | Uniform and transparent | 1.2 μm | Uniform and transparent | 1.4 μm |
| 110 | Uniform and transparent | 1.0 μm | Uniform and transparent | 1.3 μm |
| 111 | Uniform and transparent | 1.1 μm | Uniform and transparent | 1.3 μm |

TABLE 8-continued

| Example/ Comparative Example | Evaluation of solution stability: Immediately after preparation: Visual observation | Immediately after preparation: Average particle diameter | Leaving for 2 weeks and stirring: Visual observation | Leaving for 2 weeks and stirring: Average particle diameter |
|---|---|---|---|---|
| 112 | Uniform and transparent | 1.3 μm | Uniform and transparent | 1.4 μm |
| 113 | Uniform and transparent | 1.2 μm | Uniform and transparent | 1.3 μm |
| 114 | Uniform and transparent | 1.1 μm | Uniform and transparent | 1.2 μm |
| 115 | Uniform and transparent | 1.5 μm | Uniform and transparent | 1.6 μm |
| 116 | Uniform and transparent | 1.0 μm | Uniform and transparent | 1.3 μm |
| 117 | Uniform and semi-transparent | 2.7 μm | Uniform and semi-transparent | 2.7 μm |
| 118 | Uniform and semi-transparent | 2.7 μm | Uniform and semi-transparent | 2.9 μm |
| 119 | Uniform and transparent | 1.2 μm | Uniform and transparent | 1.4 μm |
| 120 | Uniform and transparent | 1.2 μm | Uniform and transparent | 1.4 μm |
| 121 | Uniform and transparent | 1.3 μm | Uniform and transparent | 1.4 μm |
| 122 | Uniform and transparent | 1.2 μm | Uniform and transparent | 1.3 μm |
| 123 | Uniform and transparent | 1.1 μm | Uniform and transparent | 1.2 μm |
| 124 | Uniform and transparent | 1.5 μm | Uniform and transparent | 16 μm |
| 125 | Uniform and transparent | 1.1 μm | Uniform and transparent | 1.2 μm |
| 126 | Uniform and transparent | 1.2 μm | Uniform and transparent | 1.4 μm |
| 127 | Uniform and transparent | 1.5 μm | Uniform and transparent | 1.6 μm |
| 128 | Uniform blue white | 5.8 μm | Uniform blue white | 6.0 μm |
| 129 | Uniform blue white | 5.8 μm | Uniform blue white | 6.0 μm |
| 130 | Uniform and semi-transparent | 3.7 μm | Uniform and semi-transparent | 3.8 μm |
| 131 | Uniform blue white | 5.8 μm | Uniform blue white | 6.0 μm |
| 132 | Uniform and semi-transparent | 4.8 μm | Uniform and semi-transparent | 5.0 μm |
| 133 | Uniform and semi-transparent | 4.7 μm | Uniform and semi-transparent | 4.9 μm |
| 134 | Uniform and semi-transparent | 4.9 μm | Uniform and semi-transparent | 5.1 μm |
| 135 | Uniform and semi-transparent | 4.8 μm | Uniform and semi-transparent | 5.0 μm |
| 136 | Uniform and semi-transparent | 4.8 μm | Uniform and semi-transparent | 5.0 μm |
| 137 | Uniform and semi-transparent | 4.7 μm | Uniform and semi-transparent | 4.9 μm |
| 138 | Uniform and semi-transparent | 4.8 μm | Uniform and semi-transparent | 5.0 μm |
| 139 | Uniform blue white | 5.8 μm | Uniform blue white | 6.0 μm |
| 140 | Uniform blue white | 5.9 μm | Uniform blue white | 6.0 μm |
| 141 | Uniform blue white | 5.7 μm | Uniform blue white | 5.9 μm |
| 142 | Uniform blue white | 5.9 μm | Uniform blue white | 6.0 μm |
| 143 | Uniform blue white | 5.7 μm | Uniform blue white | 5.9 μm |
| 144 | Uniform blue white | 7.2 μm | Uniform blue white | 7.5 μm |

TABLE 8-continued

| | Evaluation of solution stability | | | |
|---|---|---|---|---|
| | Immediately after preparation | | Leaving for 2 weeks and stirring | |
| | Visual observation | Average particle diameter | Visual observation | Average particle diameter |
| 145 | Uniform blue white | 5.9 μm | Uniform blue white | 6.0 μm |
| 146 | Uniform blue white | 5.7 μm | Uniform blue white | 5.9 μm |
| 147 | Uniform blue white | 7.2 μm | Uniform blue white | 7.5 μm |
| 148 | Uniform blue white | 7.3 μm | Uniform blue white | 7.6 μm |
| 149 | Uniform and semi-transparent | 4.8 μm | Uniform and semi-transparent | 5.0 μm |
| 150 | Uniform blue white | 7.8 μm | Uniform blue white | 8.1 μm |
| 151 | Uniform blue white | 8.0 μm | Uniform blue white | 8.3 μm |
| 152 | Uniform blue white | 11.2 μm | Opaque white | 13.5 μm |
| Comparative Example 1 | Sedimented | 19.3 μm | Aggregated | 90.2 μm |
| Comparative Example 2 | Aggregated | 140 μm | Not emulsified | — |
| Comparative Example 3 | Aggregated | 115 μm | Not emulsified | — |
| Comparative Example 4 | Aggregated | 124 μm | Not emulsified | — |
| Comparative Example 5 | Sedimented | 20.4 μm | Aggregated | 102 μm |
| Comparative Example 6 | Sedimented | 19.5 μm | Aggregated | 94.3 μm |
| Comparative Example 7 | Not emulsified | — | Not emulsified | — |
| Comparative Example 8 | Sedimented | 18.5 μm | Aggregated | 96.4 μm |

From comparison of Examples with Comparative Examples, in preparation of the emulsion by preparing the solution containing the charge transporting substance and the resin having a carbonyl group and dispersing the solution in water, if the amine compound is added and the emulsion is prepared, a stable emulsified state is kept even during long-term preservation, and the same emulsion as that immediately after preparation is kept. In the emulsion described in Japanese Patent Application Laid-Open No. 2011-128213, however, by addition of the surfactant, the emulsion particles containing the charge transporting substance and the resin are relatively stable immediately after the emulsion is prepared, but the emulsion particles may coalesce after long-term preservation, leading to aggregation. A method for increasing the content of the surfactant to suppress coalescence of the emulsion particle is thought, but usually, the surfactant easily results in reduction in the electrophotographic properties.

Example 153

An aluminum cylinder having a diameter of 30 mm and a length of 260.5 mm was used as the support (electrically conductive support). Next, 10 parts of $SnO_2$ coated barium sulfate (conductive particle), 2 parts of titanium oxide (pigment for adjusting resistance), 6 parts of a phenol resin, and 0.001 parts of a silicone oil (leveling agent) were dissolved using a mixed solvent of 4 parts of methanol and 16 parts of methoxypropanol to prepare a coating solution for an electrically conductive layer. The coating solution for an electrically conductive layer was applied onto the aluminum cylinder by dip coating. The obtained coat was cured (thermally cured) at 140° C. for 30 minutes to form an electrically conductive layer having a film thickness of 15 μm.

Next, 3 parts of N-methoxymethylated nylon and 3 parts of a copolymerized nylon were dissolved in a mixed solvent of 65 parts of methanol and 30 parts of n-butanol to prepare a coating solution for an undercoat layer. The coating solution for an undercoat layer was applied onto the electrically conductive layer by dip coating. The obtained coat was dried at 100° C. for 10 minutes to form an undercoat layer having a film thickness of 0.7 μm.

Next, 10 parts of a crystalline hydroxy gallium phthalocyanine (charge generating substance) having strong peaks at Bragg angles (2θ±0.2°) of 7.5°, 9.9°, 16.3°, 18.6°, 25.1°, and 28.3° in CuKα properties X ray diffraction was prepared. 250 parts of cyclohexanone and 5 parts of a polyvinyl butyral resin (trade name: S-LEC BX-1, made by Sekisui Chemical Co., Ltd.) were mixed with the hydroxy gallium phthalocyanine, and dispersed for 1 hour under an atmosphere of 23±3° C. using a sand mill apparatus having glass beads whose diameter was 1 mm. After dispersion, 250 parts of ethyl acetate was added to prepare a coating solution for a charge generating layer. The coating solution for a charge generating layer was applied onto the undercoat layer by dip coating. The obtained coat was dried at 100° C. for 10 minutes to form a charge generating layer having a film thickness of 0.26 μm.

Next, as the coating solution for a charge transporting layer (emulsion for a charge transporting layer), the emulsion prepared in Example 1 was applied onto the charge generating layer by dip coating to form a coat of the emulsion. The obtained coat was heated at 130° C. for 1 hour to form a charge transporting layer having a film thickness of 10 μm. Thus, an electrophotographic photosensitive member was produced. The used emulsion and the heating condition for the coat formed by applying the emulsion are shown in Table 9. The emulsion used for dip coating was left as it was for 2 weeks (under an environment of the temperature of 23° C. and humidity of 50% RH), and stirred at 1,000 turns/min for 3 minutes by a homogenizer.

Next, evaluations will be described.

<Evaluation of Uniformity of Coat Surface>

A place 130 mm from the upper end of the surface of the electrophotographic photosensitive member was measured using a surface roughness measuring apparatus (SURFCORDER SE-3400, made by Kosaka Laboratory Ltd.), and evaluation was made according to evaluation of the ten-point height of irregularities (Rzjis) according to JIS B 0601:2001 (evaluation length of 10 mm). The results are shown in Table 9.

<Evaluation of Image>

In a laser beam printer LBP-2510 made by Canon Inc., the charge potential (dark potential) of the electrophotographic photosensitive member and the exposure amount (image exposure amount) of a laser light source at 780 nm were modified such that the light amount on the surface of the electrophotographic photosensitive member was 0.3 μJ/cm$^2$. The thus-modified laser beam printer LBP-2510 was used. Evaluation was made under an environment of the temperature of 23° C. and relative humidity of 15%. In evaluation of an image, an A4 size normal paper was used, and a halftone image of a single color was output. The output image was visually evaluated on the criterion below. The results are shown in Table 9.

Rank A: a totally uniform image is found
Rank B: very slight unevenness is found in an image
Rank C: unevenness is found in an image
Rank D: remarkable unevenness is found in an image Examples 154 to 304

An electrophotographic photosensitive member was produced by the same method as that in Example 153 except that the emulsion was used in formation of the charge transporting layer as shown in Tables 9 and 10, and the heating condition for the coat formed by applying the emulsion was changed as shown in Tables 9 and 10. The photosensitive member was evaluated by the same method as that in Example 153. The results are shown in Tables 9 and 10.

Comparative Examples 9 to 14, and 16 to 22

An electrophotographic photosensitive member was produced by the same method as that in Example 153 except that the emulsion was used in formation of the charge transporting layer as shown in Table 10, and the heating condition for the coat formed by applying the emulsion was changed as shown in Table 10. The photosensitive member was evaluated by the same method as that in Example 153. The results are shown in Table 10. Gentle depressions and projections were formed on the obtained electrophotographic photosensitive member, and unevenness of the image corresponding to the depressions and projections was detected as the image.

Comparative Example 15

An electrophotographic photosensitive member was produced by the same method as that in Example 153 except that the prepared emulsion was not left for 2 weeks, and was immediately applied by dip coating, the emulsion was used in formation shown in Table 10, and the heating condition for the coat formed by applying the emulsion was changed as shown in Table 10. The photosensitive member was evaluated by the same method as that in Example 153. The results are shown in Table 10. Gentle depressions and projections were formed on the obtained electrophotographic photosensitive member, and unevenness of the image corresponding to the depressions and projections was detected as the image.

TABLE 9

| Example | Emulsion | Heating condition | | Evaluation of coat | Evaluation |
|---|---|---|---|---|---|
| | | Temperature | Time | uniformity | of image |
| 153 | Example 1 | 130° C. | 60 minutes | 0.52 μm | A |
| 154 | Example 2 | 130° C. | 60 minutes | 0.55 μm | A |
| 155 | Example 3 | 130° C. | 60 minutes | 0.51 μm | A |
| 156 | Example 4 | 130° C. | 60 minutes | 0.45 μm | A |
| 157 | Example 5 | 130° C. | 60 minutes | 0.44 μm | A |
| 158 | Example 6 | 130° C. | 60 minutes | 0.47 μm | A |
| 159 | Example 7 | 130° C. | 60 minutes | 0.52 μm | A |
| 160 | Example 8 | 130° C. | 60 minutes | 0.53 μm | A |
| 161 | Example 9 | 130° C. | 60 minutes | 0.52 μm | A |
| 162 | Example 10 | 130° C. | 60 minutes | 0.53 μm | A |
| 163 | Example 11 | 130° C. | 60 minutes | 0.54 μm | A |
| 164 | Example 12 | 130° C. | 60 minutes | 0.52 μm | A |
| 165 | Example 13 | 130° C. | 60 minutes | 0.52 μm | A |
| 166 | Example 14 | 130° C. | 60 minutes | 0.51 μm | A |
| 167 | Example 15 | 130° C. | 60 minutes | 0.52 μm | A |
| 168 | Example 16 | 130° C. | 60 minutes | 0.44 μm | A |
| 169 | Example 17 | 130° C. | 60 minutes | 0.46 μm | A |
| 170 | Example 18 | 130° C. | 60 minutes | 0.43 μm | A |
| 171 | Example 19 | 130° C. | 60 minutes | 0.43 μm | A |

TABLE 9-continued

| Example | Emulsion | Heating condition | | Evaluation of coat | Evaluation |
|---|---|---|---|---|---|
| | | Temperature | Time | uniformity | of image |
| 172 | Example 20 | 130° C. | 60 minutes | 0.44 μm | A |
| 173 | Example 21 | 130° C. | 60 minutes | 0.47 μm | A |
| 174 | Example 22 | 130° C. | 60 minutes | 0.43 μm | A |
| 175 | Example 23 | 130° C. | 60 minutes | 0.44 μm | A |
| 176 | Example 24 | 130° C. | 60 minutes | 0.47 μm | A |
| 177 | Example 25 | 130° C. | 60 minutes | 0.45 μm | A |
| 178 | Example 26 | 130° C. | 60 minutes | 0.44 μm | A |
| 179 | Example 27 | 130° C. | 60 minutes | 0.45 μm | A |
| 180 | Example 28 | 130° C. | 60 minutes | 0.47 μm | A |
| 181 | Example 29 | 130° C. | 60 minutes | 0.44 μm | A |
| 182 | Example 30 | 130° C. | 60 minutes | 0.45 μm | A |
| 183 | Example 31 | 130° C. | 60 minutes | 0.47 μm | A |
| 184 | Example 32 | 130° C. | 60 minutes | 0.44 μm | A |
| 185 | Example 33 | 130° C. | 60 minutes | 0.45 μm | A |
| 186 | Example 34 | 130° C. | 60 minutes | 0.45 μm | A |
| 187 | Example 35 | 130° C. | 60 minutes | 0.46 μm | A |
| 188 | Example 36 | 130° C. | 60 minutes | 0.46 μm | A |
| 189 | Example 37 | 130° C. | 60 minutes | 0.47 μm | A |
| 190 | Example 38 | 130° C. | 60 minutes | 0.51 μm | A |
| 191 | Example 39 | 130° C. | 40 minutes | 0.52 μm | A |
| 192 | Example 40 | 150° C. | 60 minutes | 0.42 μm | A |
| 193 | Example 41 | 130° C. | 60 minutes | 0.45 μm | A |
| 194 | Example 42 | 130° C. | 60 minutes | 0.44 μm | A |
| 195 | Example 43 | 130° C. | 60 minutes | 0.45 μm | A |
| 196 | Example 44 | 150° C. | 40 minutes | 0.47 μm | A |
| 197 | Example 45 | 130° C. | 60 minutes | 0.44 μm | A |
| 198 | Example 46 | 130° C. | 60 minutes | 0.45 μm | A |
| 199 | Example 47 | 130° C. | 60 minutes | 0.47 μm | A |
| 200 | Example 48 | 150° C. | 60 minutes | 0.43 μm | A |
| 201 | Example 49 | 130° C. | 60 minutes | 0.44 μm | A |
| 202 | Example 50 | 130° C. | 60 minutes | 0.46 μm | A |
| 203 | Example 51 | 130° C. | 60 minutes | 0.46 μm | A |
| 204 | Example 52 | 130° C. | 60 minutes | 0.45 μm | A |
| 205 | Example 53 | 130° C. | 60 minutes | 0.47 μm | A |
| 206 | Example 54 | 130° C. | 60 minutes | 0.45 μm | A |
| 207 | Example 55 | 130° C. | 60 minutes | 0.46 μm | A |
| 208 | Example 56 | 130° C. | 60 minutes | 0.53 μm | A |
| 209 | Example 57 | 130° C. | 60 minutes | 0.52 μm | A |
| 210 | Example 58 | 130° C. | 60 minutes | 0.42 μm | A |
| 211 | Example 59 | 130° C. | 60 minutes | 0.47 μm | A |
| 212 | Example 60 | 130° C. | 60 minutes | 0.43 μm | A |
| 213 | Example 61 | 130° C. | 60 minutes | 0.44 μm | A |
| 214 | Example 62 | 130° C. | 60 minutes | 0.45 μm | A |
| 215 | Example 63 | 130° C. | 60 minutes | 0.45 μm | A |
| 216 | Example 64 | 130° C. | 60 minutes | 0.44 μm | A |
| 217 | Example 65 | 130° C. | 60 minutes | 0.47 μm | A |
| 218 | Example 66 | 130° C. | 60 minutes | 0.43 μm | A |
| 219 | Example 67 | 130° C. | 40 minutes | 0.51 μm | A |
| 220 | Example 68 | 150° C. | 60 minutes | 0.51 μm | A |
| 221 | Example 69 | 130° C. | 60 minutes | 0.42 μm | A |
| 222 | Example 70 | 130° C. | 60 minutes | 0.51 μm | A |
| 223 | Example 71 | 130° C. | 60 minutes | 0.51 μm | A |
| 224 | Example 72 | 150° C. | 40 minutes | 0.44 μm | A |
| 225 | Example 73 | 130° C. | 60 minutes | 0.45 μm | A |
| 226 | Example 74 | 130° C. | 60 minutes | 0.45 μm | A |
| 227 | Example 75 | 130° C. | 60 minutes | 0.44 μm | A |
| 228 | Example 76 | 150° C. | 60 minutes | 0.47 μm | A |
| 229 | Example 77 | 130° C. | 60 minutes | 0.46 μm | A |
| 230 | Example 78 | 130° C. | 60 minutes | 0.46 μm | A |
| 231 | Example 79 | 130° C. | 60 minutes | 0.49 μm | A |
| 232 | Example 80 | 130° C. | 60 minutes | 0.67 μm | B |
| 233 | Example 81 | 130° C. | 60 minutes | 0.62 μm | B |
| 234 | Example 82 | 130° C. | 60 minutes | 0.57 μm | A |
| 235 | Example 83 | 130° C. | 60 minutes | 0.58 μm | A |
| 236 | Example 84 | 130° C. | 60 minutes | 0.59 μm | A |
| 237 | Example 85 | 130° C. | 60 minutes | 0.60 μm | B |
| 238 | Example 86 | 130° C. | 60 minutes | 0.59 μm | A |
| 239 | Example 87 | 130° C. | 60 minutes | 0.58 μm | A |
| 240 | Example 88 | 130° C. | 60 minutes | 0.60 μm | B |
| 241 | Example 89 | 130° C. | 60 minutes | 0.59 μm | A |
| 242 | Example 90 | 130° C. | 60 minutes | 0.59 μm | A |
| 243 | Example 91 | 130° C. | 60 minutes | 0.58 μm | A |
| 244 | Example 92 | 130° C. | 60 minutes | 0.59 μm | A |
| 245 | Example 93 | 130° C. | 60 minutes | 0.52 μm | A |
| 246 | Example 94 | 130° C. | 60 minutes | 0.51 μm | A |

TABLE 9-continued

| Example | Emulsion | Heating condition Temperature | Heating condition Time | Evaluation of coat uniformity | Evaluation of image |
|---|---|---|---|---|---|
| 247 | Example 95 | 130° C. | 40 minutes | 0.52 μm | A |
| 248 | Example 96 | 150° C. | 60 minutes | 0.55 μm | A |
| 249 | Example 97 | 130° C. | 60 minutes | 0.54 μm | A |
| 250 | Example 98 | 130° C. | 60 minutes | 0.55 μm | A |
| 251 | Example 99 | 130° C. | 60 minutes | 0.54 μm | A |
| 252 | Example 100 | 150° C. | 40 minutes | 0.52 μm | A |
| 253 | Example 101 | 130° C. | 60 minutes | 0.51 μm | A |
| 254 | Example 102 | 130° C. | 60 minutes | 0.55 μm | A |
| 255 | Example 103 | 130° C. | 60 minutes | 0.55 μm | A |
| 256 | Example 104 | 130° C. | 60 minutes | 0.54 μm | A |
| 257 | Example 105 | 130° C. | 60 minutes | 0.51 μm | A |

TABLE 10

| Example | Emulsion | Heating condition Temperature | Heating condition Time | Evaluation of coat uniformity | Evaluation of image |
|---|---|---|---|---|---|
| Example | | | | | |
| 258 | Example 106 | 130° C. | 60 minutes | 0.52 μm | A |
| 259 | Example 107 | 130° C. | 60 minutes | 0.51 μm | A |
| 260 | Example 108 | 130° C. | 60 minutes | 0.42 μm | A |
| 261 | Example 109 | 130° C. | 60 minutes | 0.45 μm | A |
| 262 | Example 110 | 130° C. | 60 minutes | 0.43 μm | A |
| 263 | Example 111 | 130° C. | 60 minutes | 0.44 μm | A |
| 264 | Example 112 | 130° C. | 60 minutes | 0.45 μm | A |
| 265 | Example 113 | 130° C. | 60 minutes | 0.45 μm | A |
| 266 | Example 114 | 130° C. | 60 minutes | 0.44 μm | A |
| 267 | Example 115 | 130° C. | 60 minutes | 0.47 μm | A |
| 268 | Example 116 | 130° C. | 60 minutes | 0.43 μm | A |
| 269 | Example 117 | 130° C. | 60 minutes | 0.52 μm | A |
| 270 | Example 118 | 130° C. | 60 minutes | 0.52 μm | A |
| 271 | Example 119 | 130° C. | 60 minutes | 0.45 μm | A |
| 272 | Example 120 | 130° C. | 60 minutes | 0.45 μm | A |
| 273 | Example 121 | 130° C. | 60 minutes | 0.45 μm | A |
| 274 | Example 122 | 130° C. | 60 minutes | 0.45 μm | A |
| 275 | Example 123 | 130° C. | 60 minutes | 0.44 μm | A |
| 276 | Example 124 | 130° C. | 60 minutes | 0.47 μm | A |
| 277 | Example 125 | 130° C. | 60 minutes | 0.44 μm | A |
| 278 | Example 126 | 130° C. | 60 minutes | 0.45 μm | A |
| 279 | Example 127 | 130° C. | 60 minutes | 0.47 μm | A |
| 280 | Example 128 | 130° C. | 60 minutes | 0.62 μm | B |
| 281 | Example 129 | 130° C. | 60 minutes | 0.62 μm | B |
| 282 | Example 130 | 130° C. | 60 minutes | 0.55 μm | A |
| 283 | Example 131 | 130° C. | 60 minutes | 0.62 μm | B |
| 284 | Example 132 | 130° C. | 60 minutes | 0.59 μm | A |
| 285 | Example 133 | 130° C. | 60 minutes | 0.58 μm | A |
| 286 | Example 134 | 130° C. | 60 minutes | 0.60 μm | B |
| 287 | Example 135 | 130° C. | 60 minutes | 0.59 μm | A |
| 288 | Example 136 | 130° C. | 40 minutes | 0.59 μm | A |
| Example/ Comparative Example | | | | | |
| 289 | Example 137 | 150° C. | 60 minutes | 0.58 μm | A |
| 290 | Example 138 | 130° C. | 60 minutes | 0.59 μm | A |
| 291 | Example 139 | 130° C. | 60 minutes | 0.62 μm | B |
| 292 | Example 140 | 130° C. | 60 minutes | 0.63 μm | B |
| 293 | Example 141 | 150° C. | 40 minutes | 0.62 μm | B |
| 294 | Example 142 | 130° C. | 60 minutes | 0.63 μm | B |
| 295 | Example 143 | 130° C. | 40 minutes | 0.62 μm | B |
| 296 | Example 144 | 150° C. | 60 minutes | 0.67 μm | B |
| 297 | Example 145 | 130° C. | 60 minutes | 0.63 μm | B |
| 298 | Example 146 | 130° C. | 60 minutes | 0.62 μm | B |
| 299 | Example 147 | 130° C. | 60 minutes | 0.67 μm | B |
| 300 | Example 148 | 150° C. | 40 minutes | 0.68 μm | B |
| 301 | Example 149 | 130° C. | 60 minutes | 0.59 μm | B |
| 302 | Example 150 | 130° C. | 60 minutes | 0.69 μm | B |
| 303 | Example 151 | 130° C. | 60 minutes | 0.68 μm | B |
| 304 | Example 152 | 130° C. | 60 minutes | 0.72 μm | C |

TABLE 10-continued

| Example | Emulsion | Heating condition Temperature | Heating condition Time | Evaluation of coat uniformity | Evaluation of image |
|---|---|---|---|---|---|
| Comparative Example 9 | Comparative Example 1 | 130° C. | 60 minutes | 0.78 μm | C |
| Comparative Example 10 | Comparative Example 2 | 130° C. | 60 minutes | 0.88 μm | D |
| Comparative Example 11 | Comparative Example 3 | 130° C. | 40 minutes | 0.84 μm | D |
| Comparative Example 12 | Comparative Example 4 | 130° C. | 60 minutes | 0.86 μm | D |
| Comparative Example 13 | Comparative Example 5 | 130° C. | 60 minutes | 0.79 μm | C |
| Comparative Example 14 | Comparative Example 6 | 130° C. | 60 minutes | 0.78 μm | C |
| Comparative Example 15 | Comparative Example 7 | 130° C. | 60 minutes | 0.90 μm | D |
| Comparative Example 16 | Comparative Example 8 | 130° C. | 60 minutes | 0.78 μm | C |
| Comparative Example 17 | Comparative Example 1 | 150° C. | 60 minutes | 0.75 μm | C |
| Comparative Example 18 | Comparative Example 2 | 150° C. | 60 minutes | 0.82 μm | D |
| Comparative Example 19 | Comparative Example 3 | 150° C. | 40 minutes | 0.80 μm | D |
| Comparative Example 20 | Comparative Example 1 | 180° C. | 60 minutes | 0.73 μm | C |
| Comparative Example 21 | Comparative Example 2 | 180° C. | 60 minutes | 0.80 μm | D |
| Comparative Example 22 | Comparative Example 3 | 180° C. | 40 minutes | 0.78 μm | C |

The image was evaluated as Rank A or B if the surface roughness was 0.69 μm or less in evaluation of uniformity of the coat surface, and evaluated as Rank C or D if the surface roughness was 0.72 μm or more in evaluation of uniformity of the coat surface. Namely, the uniformity of the coat surface corresponds to unevenness of the image.

From comparison of Examples 153 to 304 with Comparative Examples 9 to 22, if the emulsion after preservation for a long time was used, the emulsion having the configuration described in Japanese Patent Application Laid-Open No. 2011-128213 showed the coat surface uniform less than those of the emulsions according to the present invention prepared by containing the amine compound. It is thought that this is because coalescence of the emulsion particles in the emulsion after preservation for a long time leads to aggregation of the emulsion particle to impair the uniformity of the emulsion particles in the emulsion, and as a result, the uniformity of the coat surface after formation of the coat is reduced. Moreover, even if the heating temperature for the coat is increased, the uniformity of the coat surface is improved, but sufficient uniformity of the coat surface or good evaluation of the image is not obtained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-065661, filed Mar. 22, 2012, and No. 2013-037192, filed Feb. 27, 2013, which are hereby incorporated by reference herein in their entirety.

The invention claimed is:

1. A method of producing an electrophotographic photosensitive member which comprises a support and charge transporting layer formed thereon, comprising the steps of:

preparing a solution comprising:

a charge transporting substance;

a resin having a carbonyl group; and at least one amine compound selected from the group consisting of a compound represented by the following formula (A), a compound represented by the following formula (B), a compound represented by the following formula (C), a compound represented by the following formula (D) and a compound represented by the following formula (E);

dispersing the solution in a water to prepare emulsion, forming a coat by using the emulsion, and heating the coat to form the charge transporting layer, (A)

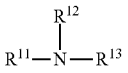

where, $R^{11}$ to $R^{13}$ each independently represents a hydrogen atom, an alkyl group having 1 to 6 carbon atoms, a hydroxyalkyl group having 1 to 3 carbon atoms or a hydroxy group, (B)

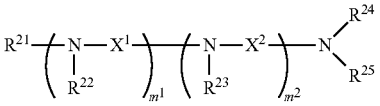

where, $R^{21}$ to $R^{25}$ each independently represents a hydrogen atom, an alkyl group having 1 to 6 carbon atoms, a hydroxyalkyl group having 1 to 3 carbon atoms or a hydroxy group, $m^1$ is 1 or 2, $m^2$ is an integer selected from 0 to 2, $X^1$ represents a divalent group represented by the following formula (BA), $X^2$ represents a divalent group represented by the following formula (BB), (BA)

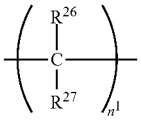

(BB)

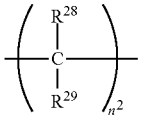

wherein, in the formula (BA), $R^{26}$ and $R^{27}$ each independently represents a hydrogen atom, a methyl group or an ethyl group, $n^1$ represents an integer selected from 1 to 6, in the formula (BB), $R^{28}$ and $R^{29}$ each independently represents a hydrogen atom, a methyl group or an ethyl group, $n^2$ represents an integer selected from 1 to 6, (C)

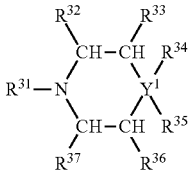

where, $R^{32}$, $R^{33}$, $R^{36}$ and $R^{37}$ each independently represents a hydrogen atom, a methyl group, a hydroxy group or an amino group, $R^{31}$ represents a hydrogen atom, an amino group, a hydroxy group or a hydroxyalkyl group having 1 to 3 carbon atoms, $Y^1$ represents a nitrogen atom, an oxygen atom or a carbon atom, $R^{34}$ and $R^{35}$ are absent when $Y^1$ is the oxygen atom, $R^{34}$ is a hydrogen atom, a hydroxy group or an amino group, and $R^{35}$ is absent when $Y^1$ is the nitrogen atom, $R^{34}$ and $R^{35}$ is each independently a hydrogen atom, a hydroxy group or an amino group when $Y^1$ is the carbon atom, $R^{31}$ and $R^{34}$ may be bonded to each other so as to be cyclic, (D)

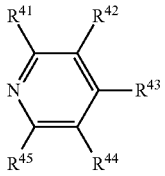

where, $R^{41}$ to $R^{45}$ each independently represents a hydrogen atom, a methyl group, a methoxy group, an amino group, a dimethylamino group or a hydroxy group, (E)

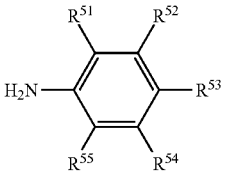

where, $R^{51}$ to $R^{55}$ each independently represents a hydrogen atom, a methyl group or an ethyl group.

2. The method of producing an electrophotographic photosensitive member according to claim 1, wherein the resin having a carbonyl group is at least one selected from the group consisting of a polycarbonate resin and polyester resin.

3. The method of producing an electrophotographic photosensitive member according to claim 1, wherein, the amount of the amine compound in the emulsion is from 0.1 to 20% by mass based on the total mass of the emulsion.

4. The method of producing an electrophotographic photosensitive member according to claim 1, wherein the amount of water in the emulsion is not less than 30% by mass and less than 100% by mass based on the total mass of the emulsion.

5. The method of producing an electrophotographic photosensitive member according to claim 1, wherein the solution further comprises liquid whose solubility in water at 25° C. and 1 atm is 1.0 mass % or less.

6. A method of producing an electrophotographic photosensitive member which comprises a support and charge transporting layer formed thereon, comprising the steps of:

preparing a solution comprising a charge transporting substance, and a resin having a carbonyl group;

dispersing the solution, and at least one amine compound selected from the group consisting of a compound represented by the following formula (A), a compound represented by the following formula (B), a compound represented by the following formula (C), a compound represented by the following formula (D) and a compound represented by the following formula (E), in a water to prepare emulsion, forming a coat by using the emulsion, and heating the coat to form the charge transporting layer, (A)

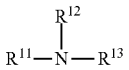

where, $R^{11}$ to $R^{13}$ each independently represents a hydrogen atom, an alkyl group having 1 to 6 carbon atoms, a hydroxyalkyl group having 1 to 3 carbon atoms or a hydroxy group, (B)

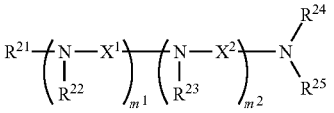

where, $R^{21}$ to $R^{25}$ each independently represents a hydrogen atom, an alkyl group having 1 to 6 carbon atoms, a hydroxyalkyl group having 1 to 3 carbon atoms or a hydroxy group, $m^1$ is 1 or 2, $m^2$ is an integer selected from 0 to 2, $X^1$ represents a divalent group represented by the following formula (BA), $X^2$ represents a divalent group represented by the following formula (BB), (BA)

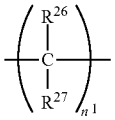

(BB)

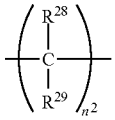

wherein, in the formula (BA), $R^{26}$ and $R^{27}$ each independently represents a hydrogen atom, a methyl group or an ethyl group, $n^1$ represents an integer selected from 1 to 6, in the formula (BB), $R^{28}$ and $R^{29}$ each independently represents a hydrogen atom, a methyl group or an ethyl group, $n^2$ represents an integer selected from 1 to 6, (C)

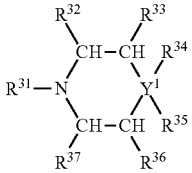

where, $R^{32}$, $R^{33}$, $R^{36}$ and $R^{37}$ each independently represents a hydrogen atom, a methyl group, a hydroxy group or an amino group, $R^{31}$ represents a hydrogen atom, an amino group, a hydroxy group or a hydroxyalkyl group having 1 to 3 carbon atoms, $Y^1$ represents a nitrogen atom, an oxygen atom or a carbon atom, $R^{34}$ and $R^{35}$ are absent when $Y^1$ is the oxygen atom, $R^{34}$ is a hydrogen atom, a hydroxy group or an amino group, and $R^{35}$ is absent when $Y^1$ is the nitrogen atom, $R^{34}$ and $R^{35}$ is each independently a hydrogen atom, a hydroxy group or an amino group when $Y^1$ is the carbon atom, $R^{31}$ and $R^{34}$ may be bonded to each other so as to be cyclic, (D)

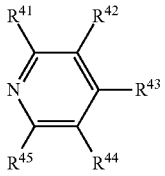

where, $R^{41}$ to $R^{45}$ each independently represents a hydrogen atom, a methyl group, a methoxy group, an amino group, a dimethylamino group or a hydroxy group, (E)

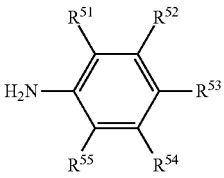

where, $R^{51}$ to $R^{55}$ each independently represents a hydrogen atom, a methyl group or an ethyl group.

7. An emulsion for a charge transporting layer in which a solution is dispersed in water, wherein the solution comprises a charge transporting substance and a resin having a carbonyl group, and the emulsion for a charge transporting layer further comprises at least one amine compound selected from the group consisting of a compound represented by the following formula (A), a compound represented by the following formula (B), a compound represented by the following formula (C), a compound represented by the following formula (D) and a compound represented by the following formula (E), (A)

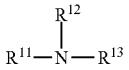

where, $R^{11}$ to $R^{13}$ each independently represents a hydrogen atom, an alkyl group having 1 to 6 carbon atoms, a hydroxyalkyl group having 1 to 3 carbon atoms or a hydroxy group, (B)

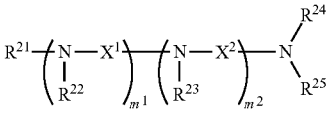

where, $R^{21}$ to $R^{25}$ each independently represents a hydrogen atom, an alkyl group having 1 to 6 carbon atoms, a hydroxyalkyl group having 1 to 3 carbon atoms or a hydroxy group, $m^1$ is 1 or 2, $m^2$ is an integer selected from 0 to 2, $X^1$ represents a divalent group represented by the following formula (BA), $X^2$ represents a divalent group represented by the following formula (BB), (BA)

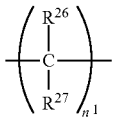

(BB)

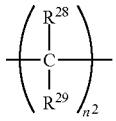

wherein, in the formula (BA), $R^{26}$ and $R^{27}$ each independently represents a hydrogen atom, a methyl group or an ethyl group, $n^1$ represents an integer selected from 1 to 6, in the formula (BB), $R^{28}$ and $R^{29}$ each independently represents a hydrogen atom, a methyl group or an ethyl group, $n^2$ represents an integer selected from 1 to 6, (C)

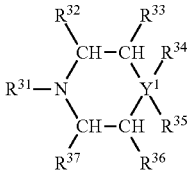

where, $R^{32}$, $R^{33}$, $R^{36}$ and $R^{37}$ each independently represents a hydrogen atom, a methyl group, a hydroxy group or an amino group, $R^{31}$ represents a hydrogen atom, an amino group, a hydroxy group or a hydroxyalkyl group having 1 to 3 carbon atoms, $Y^1$ represents a nitrogen atom, an oxygen atom or a carbon atom, $R^{34}$ and $R^{35}$ are absent when $Y^1$ is the oxygen atom, $R^{34}$ is a hydrogen atom, a hydroxy group or an amino group, and $R^{35}$ is absent when $Y^1$ is the nitrogen atom, $R^{34}$ and $R^{35}$ is each independently a hydrogen atom, a hydroxy group or an amino group when $Y^1$ is the carbon atom, $R^{31}$ and $R^{34}$ may be bonded to each other so as to be cyclic, (D)

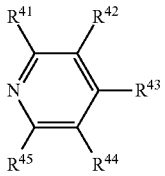

where, $R^{41}$ to $R^{45}$ each independently represents a hydrogen atom, a methyl group, a methoxy group, an amino group, a dimethylamino group or a hydroxy group, (E)

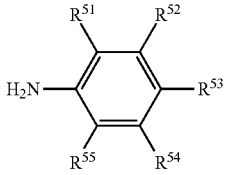

where, $R^{51}$ to $R^{55}$ each independently represents a hydrogen atom, a methyl group or an ethyl group.

8. The emulsion for a charge transporting layer according to claim 7, wherein the resin having a carbonyl group is at least one selected from the group consisting of a polycarbonate resin and polyester resin.

9. The emulsion for a charge transporting layer according to claim 7, wherein the amount of the amine compound in the emulsion is from 0.1 to 20% by mass based on the total mass of the emulsion.

10. The emulsion for a charge transporting layer according to claim 7, wherein the amount of water in the emulsion is not less than 30% by mass and less than 100% by mass based on the total mass of the emulsion.

11. The emulsion for a charge transporting layer according to claim 7, wherein the solution further comprises liquid whose solubility in water at 25° C. and 1 atm is 1.0 mass % or less.

* * * * *